US011878783B2

(12) United States Patent
Raffills et al.

(10) Patent No.: US 11,878,783 B2
(45) Date of Patent: Jan. 23, 2024

(54) MARINE DEVICE POSITION ADJUSTMENT ASSEMBLY

(71) Applicant: Navico, Inc., Tulsa, OK (US)

(72) Inventors: Joseph Donald Frederick Raffills, Auckland (NZ); Antony Michael Mackenzie, Auckland (NZ)

(73) Assignee: Navico, Inc., Tulsa, OK (US)

( * ) Notice: Subject to any disclaimer, the term of this patent is extended or adjusted under 35 U.S.C. 154(b) by 296 days.

(21) Appl. No.: 17/463,773

(22) Filed: Sep. 1, 2021

(65) Prior Publication Data

US 2023/0062830 A1 Mar. 2, 2023

(51) Int. Cl.

| | |
|---|---|
| ***B63H 20/00*** | (2006.01) |
| ***B63H 20/10*** | (2006.01) |
| ***B63H 20/12*** | (2006.01) |

(52) U.S. Cl.

CPC ..... *B63H 20/007* (2013.01); *B63H 20/106* (2013.01); *B63H 20/12* (2013.01)

(58) Field of Classification Search

CPC .... B63H 20/007; B63H 20/106; B63H 20/12; B63H 20/02

USPC ..... 248/642

See application file for complete search history.

(56) References Cited

U.S. PATENT DOCUMENTS

| | | | | |
|---|---|---|---|---|
| 3,876,255 | A | 4/1975 | Ilon | |
| 4,382,796 | A * | 5/1983 | Blanchard | F02B 61/045 440/58 |
| 5,030,145 | A * | 7/1991 | Chase | B63H 20/08 440/26 |
| 8,888,542 | B2 * | 11/2014 | Kinpara | B63H 21/17 440/6 |
| 2022/0234712 | A1 * | 7/2022 | Arvidsson | B63H 5/1252 |

OTHER PUBLICATIONS

"Mecanum Wheel;" *Wikipedia*; Aug. 19, 2021; retrieved Sep. 20, 2021 from https://en.wikipedia.org/wiki/Mecanum_wheel.

* cited by examiner

*Primary Examiner* — Nkeisha Smith

(74) *Attorney, Agent, or Firm* — Nelson Mullins Riley & Scarborough LLP

(57) ABSTRACT

A marine device assembly, such including a trolling motor and/or at least one sonar transducer, is provided for attachment to a watercraft. The trolling motor and/or sonar transducer is attached at an end of a shaft. The marine device assembly includes a position adjustment assembly comprising a plurality of rotatable drums surrounding the shaft that are configured to adjust the rotational and/or vertical position of the trolling motor and/or sonar transducer(s) in accordance with a position adjustment command. In various aspects, the drums are configured to independently rotate about the shaft in a clockwise or counterclockwise direction so as to cause the trolling motor and/or sonar transducer(s) to rotate about the central axis of the shaft and/or translate along the central axis of the shaft.

21 Claims, 12 Drawing Sheets

MARINE DEVICE POSITION ADJUSTMENT ASSEMBLY

FIELD OF THE INVENTION

Embodiments of the present invention relate generally to position adjustment assemblies for marine devices and, more particularly, to systems, assemblies, and associated methods for electronically adjusting the rotational and/or vertical position of marine devices that are coupled to a shaft attached to a watercraft.

BACKGROUND OF THE INVENTION

Marine devices such as trolling motors and sonar systems are often used during fishing or other marine activities. Trolling motor assemblies, for example, attach to the watercraft and propel the watercraft along a body of water. Known mechanisms for changing the angular orientation of the trolling motor so as to control the direction of thrust include mechanical steering (e.g., via a tiller handle, cables coupled to a foot pedal, etc.) and electronic steering having a secondary motor that can be controlled remotely (e.g., via a wired foot pedal, watercraft navigation system, or wireless remote control). Likewise, the directionality of other marine devices such as Sonar (SOund Navigation And Ranging) devices may be adjusted to direct sonar beams through the water toward a desired underwater target (e.g., fish, structure, bottom surface of the water, etc.).

As opposed to changing the angular orientation of marine devices within the water, users may additionally or alternatively wish to adjust the vertical positioning of the marine device relative to the water surface. For example, a user may wish to retract a shaft to which a trolling motor is attached in order to decrease the depth of the trolling motor, for example, to avoid a collision with an underwater object or the bottom surface.

There remains a need for improved mechanisms for reliably adjusting the rotational and/or vertical position of marine devices disposed within a body of water.

BRIEF SUMMARY OF THE INVENTION

As noted above, electronically-controlled trolling motor assemblies generally include a small trolling motor that provides the thrust, while a secondary, electric steering motor may be utilized to rotate the trolling motor to various angular positions so as to precisely control the propulsion direction for steering. In addition, some conventional trolling motor assemblies utilize a third motor operatively coupled to a rubber belt extending the length of the shaft to which the trolling motor is attached in order to adjust the depth of the trolling motor. Such position adjustment systems may be bulky, complicated, and/or liable to fail. For example, the long rubber belt utilized to control the depth of the trolling motor is typically exposed, thus increasing the likelihood of failure (e.g., snapping) in the event of a collision.

Applicant has developed systems, assemblies, and methods detailed herein to improve features and capabilities for electronic position adjustment of marine devices of marine device assemblies, such as trolling motor assemblies and/or sonar transducer assembly. In some example embodiments of the present invention, a compact trolling motor adjustment assembly offering improved environmental protection can independently and/or simultaneously rotate and vertically adjust the position of the trolling motor in accordance with a position adjustment command. It will be appreciated that although the description herein commonly refers to adjusting the position of a trolling motor disposed on the end of a shaft, for example, the present teachings can likewise be implemented with respect to a variety of marine devices which may benefit from the improved techniques for angular and/or vertical positioning described herein. By way of non-limiting example, the positioning assemblies exemplified herein may likewise be applied to "steer" a sonar assembly to adjust the sonar coverage volume by rotating the one or more sonar transducers and/or adjusting their vertical position (e.g., depth).

In some example embodiments of the present invention, a trolling motor assembly configured for attachment to a watercraft is provided, the trolling motor assembly comprising a trolling motor adjustment assembly configured to adjust a rotation and/or vertical position of a trolling motor attached to a shaft extending along a central axis, wherein, when the trolling motor is attached to the watercraft and is submerged in a body of water, the trolling motor, when operating, is configured to propel the watercraft to travel along the body of water. The trolling motor adjustment assembly can comprise a plurality of rotatable drums surrounding the shaft, wherein each drum comprises a plurality of rollers disposed about an outer surface of the shaft and configured to be in contact therewith. The trolling motor adjustment assembly can also comprise a trolling motor adjustment assembly control system having a processor and a memory including program code configured to, when executed, cause the processor to receive a position adjustment command; apply a first drive signal to cause a first drum of the plurality of rotatable drums to rotate about the shaft in one of a first or second circumferential direction in response to the position adjustment command; and apply a second drive signal to cause a second drum of the plurality of rotatable drums to rotate about the shaft in one of a first or second circumferential direction in response to the position adjustment command. The first and second drive signals can be configured to cause the trolling motor to at least one of rotate about the central axis of the shaft or translate along the central axis of the shaft.

The trolling motor assembly can have a variety of configurations. By way of example, the trolling motor assembly may comprise a trolling motor at least partially contained within a trolling motor housing, wherein, the trolling motor assembly is attached to the watercraft and the trolling motor housing is submerged in a body of water. In some example embodiments, the trolling motor assembly may further comprise a main housing connected to the shaft proximate the first end of the shaft, wherein the main housing is configured to be positioned out of the body of water when the trolling motor assembly is attached to the watercraft and the trolling motor housing is submerged in the body of water.

In some example embodiments, a first motor may be associated with the first drum and a second motor may be associated with the second drum, wherein the first drive signal is configured to control the operation of the first motor and the second drive signal is configured to control the operation of the second motor. For example, in some aspects, the first motor may be operatively coupled to the first drum via a first drive belt and the second motor may be operatively coupled to the second drum via a second drive belt.

The respective drive signals can cause the first and second drums to operate in a coordinated manner so as to adjust the rotational and/or vertical position of the trolling motor in accordance with the position adjustment command. By way of example, in certain embodiments, the first and second drive signals can be configured to cause the trolling motor to translate along the central axis of the shaft in an instance in which the circumferential directions of rotation of the first and second drums are opposite. For example, the first drive signal may be configured to cause the first drum to rotate about the central axis of the shaft in a first circumferential direction (e.g., clockwise) and the second drive signal may be configured to cause the second drum to rotate about the central axis of the shaft in an opposite, second circumferential direction (e.g., counterclockwise) such that the trolling motor translates in a first axial direction (e.g., up). Alternatively, when the first drive signal is configured to cause the first drum to rotate about the central axis of the shaft in the second circumferential direction (e.g., counterclockwise) and the second drive signal is configured to cause the second drum to rotate about the central axis of the shaft in the first circumferential direction (e.g., clockwise), the trolling motor translates in a second axial direction (e.g., down) opposite to the first axial direction.

Additionally, in some aspects, in an instance in which the circumferential directions of rotation of the first and second drums are opposite so as to cause the trolling motor to translate along the central axis of the shaft, a difference in speed between the circumferential rotations of the first and second drums may be configured to further cause the trolling motor to rotate about the central axis of the shaft.

As noted above, the respective drive signals can additionally cause the first and second drums to operate in a coordinated manner so as to adjust the rotational position of the trolling motor in accordance with the position adjustment command. By way of example, in certain embodiments, the first and second drive signals can be configured to cause the trolling motor to rotate about the central axis of the shaft in an instance in which the circumferential directions of rotation of the first and second drums are the same. For example, the first and second drive signals may be configured to cause the first and second drums to rotate about the central axis of the shaft in the same circumferential direction (e.g., clockwise) such that the trolling motor rotates about the central axis in a first circumferential direction (e.g., counterclockwise). Alternatively, when the first and second drive signals cause the first and second drums to rotate about the central axis of the shaft in the second circumferential direction (e.g., counterclockwise), the trolling motor may rotate about the central axis in a second, opposite circumferential direction (e.g., clockwise).

Additionally, in some aspects, in an instance in which the circumferential directions of rotation of the first and second drums are the same so as to cause the trolling motor to rotate about the central axis of the shaft, a difference in speed between the circumferential rotations of the first and second drums may be configured to further cause the trolling motor to translate along the central axis of the shaft.

In some example embodiments, the trolling motor assembly may comprise a housing configured to contain the plurality of rotatable drums, the housing comprising at least one through-hole through which the shaft extends. In certain aspects, the at least one through-hole may be configured to form a seal with the outer surface of the shaft, for example, to prevent the incursion of water into the housing.

The rollers can have a variety of configurations in accordance with the present teachings, but each may generally be configured to extend along and rotate about a longitudinal axis. In some example embodiments, each of the plurality of rollers may comprise a resilient material configured to be compressed against the outer surface of the shaft. In certain aspects, the resilient material may comprise rubber, by way of non-limiting example.

In certain embodiments, each of the respective longitudinal axes of the plurality of rollers may be angled obliquely relative to the first and second circumferential directions of rotation and the central axis of the shaft. By way of non-limiting example, the respective longitudinal axes of the plurality of rollers may be offset by about 45 degrees relative to the central axis of the shaft. In some example embodiments, the rollers of the first and second drums are diagonally disposed opposite one another (e.g., +45 degrees and −45 degrees relative to the central axis).

In some example embodiments, the respective longitudinal axes of the plurality of rollers of the first drum may be skewed relative to one another and the respective longitudinal axes of the plurality of rollers of the second drum may be skewed relative to one another.

In another example embodiment, a method is provided. The method comprises receiving a position adjustment command for a trolling motor assembly, wherein the trolling motor assembly is configured for attachment to a watercraft, wherein the trolling motor assembly comprises a shaft extending along a central axis from a first end to a second end and a trolling motor at least partially contained within a trolling motor housing, wherein the trolling motor housing is attached to the second end of the shaft. The trolling motor assembly may be attached to the watercraft such that when the trolling motor housing is submerged in a body of water, the trolling motor, when operating, is configured to propel the watercraft to travel along the body of water. The trolling motor assembly may further comprise a trolling motor adjustment assembly comprising a plurality of rotatable drums surrounding the shaft, wherein each drum comprises a plurality of rollers disposed about an outer surface of the shaft and configured to be in contact therewith. In accordance with the example embodiment of the method, a first drive signal may be applied to cause a first drum of the plurality of rotatable drums to rotate about the shaft in one of a first or second circumferential direction in response to the position adjustment command, and a second drive signal may be applied to cause a second drum of the plurality of rotatable drums to rotate about the shaft in one of a first or second circumferential direction in response to the position adjustment command, wherein the first and second drive signals are configured to cause the trolling motor to at least one of rotate about the central axis of the shaft or to translate along the central axis of the shaft.

The respective drive signals can cause the first and second drums to operate in a coordinated manner so as to adjust the rotational and/or vertical position of the trolling motor in accordance with the position adjustment command. For example, in some example embodiments, the first and second drive signals can be configured to cause the first and second drums to operate so as to simultaneously adjust both the clockwise/counterclockwise rotation and up/down translation of the trolling motor in accordance with the position adjustment command. However, in some example embodiments, the first and second drive signals may be configured to cause the trolling motor to only rotate about the central axis of the shaft, without translating along the central axis of the shaft. Alternatively, in some example embodiments, the first and second drive signals may be configured to cause the trolling motor to only translate along the central axis of the shaft, without rotating about the central axis of the shaft.

These and other features of the Applicant's teaching are set forth herein.

BRIEF DESCRIPTION OF THE DRAWINGS

Figure 1:
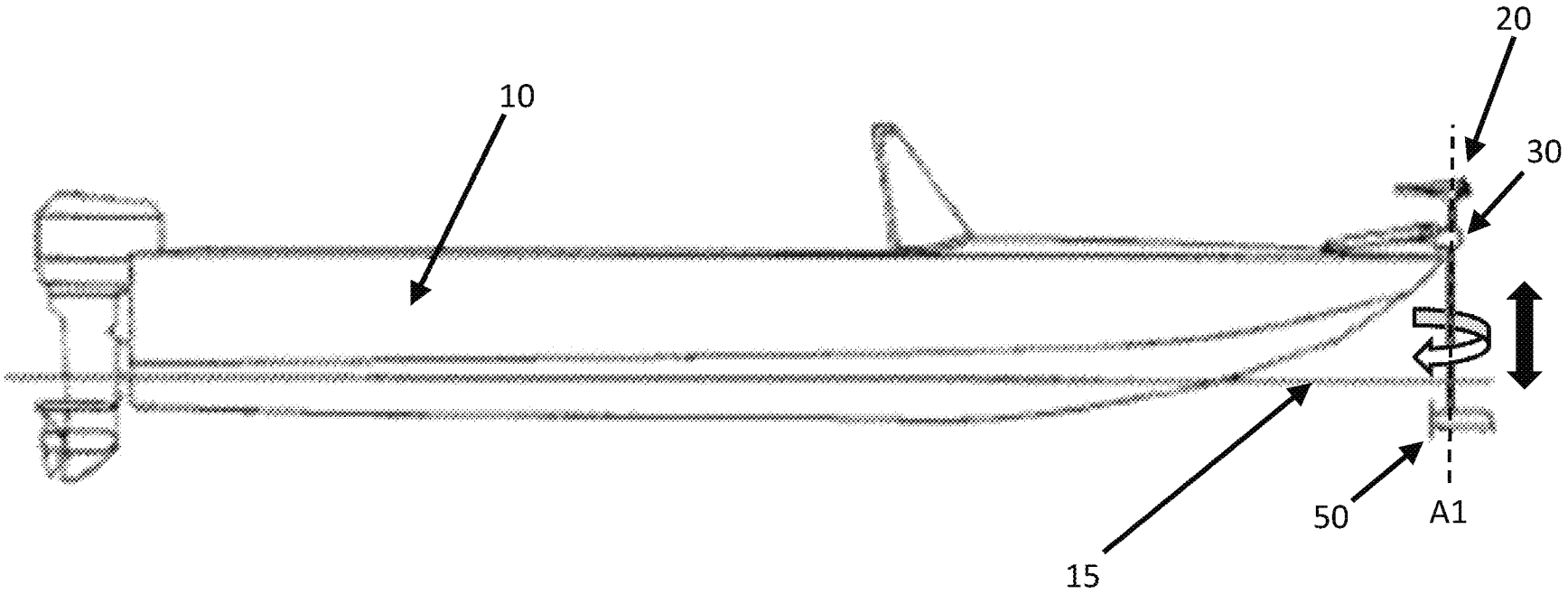
Figure 2:
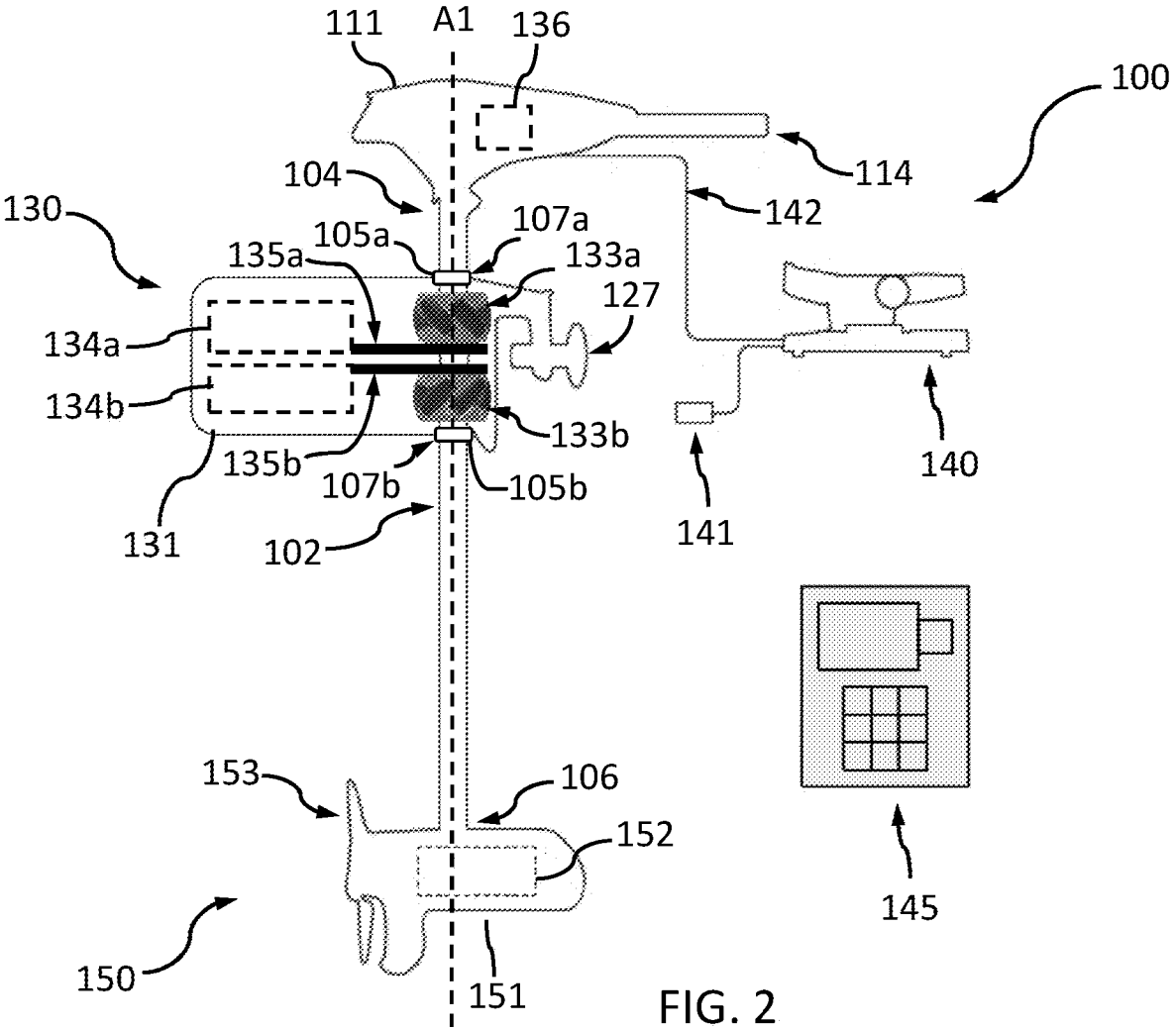
Figure 3B:
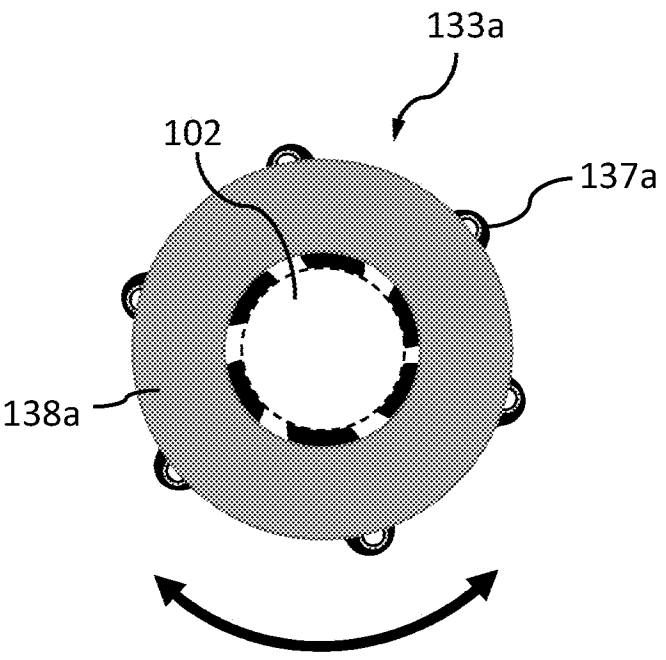
Figure 3A:
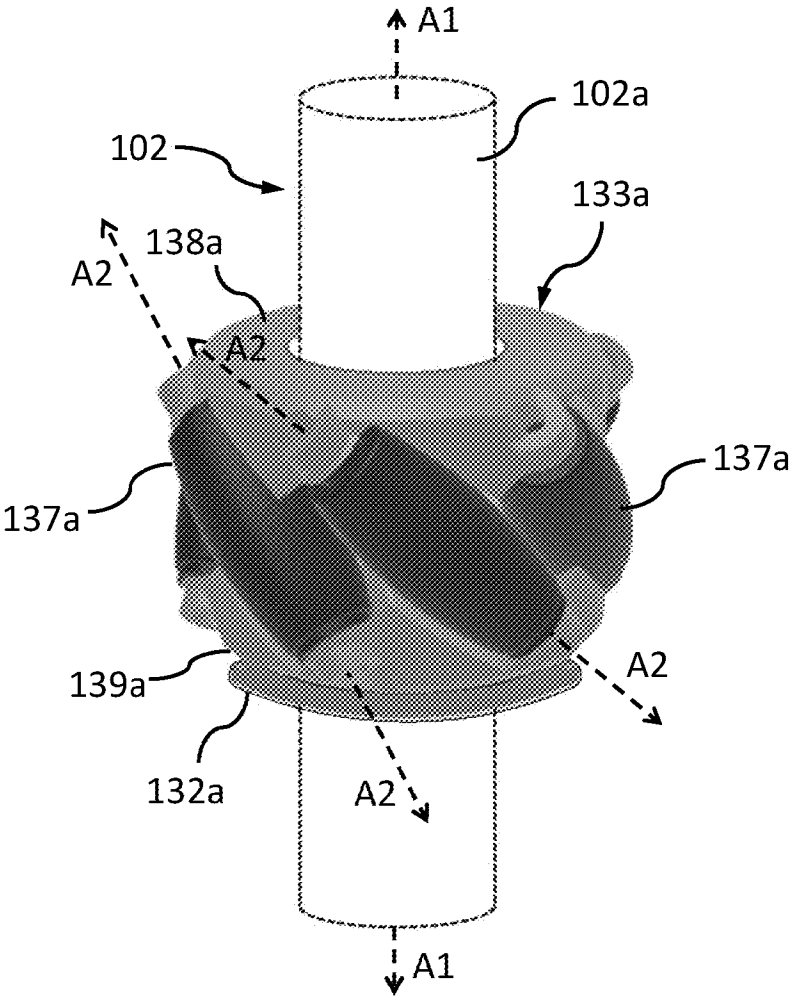
Figure 4B:
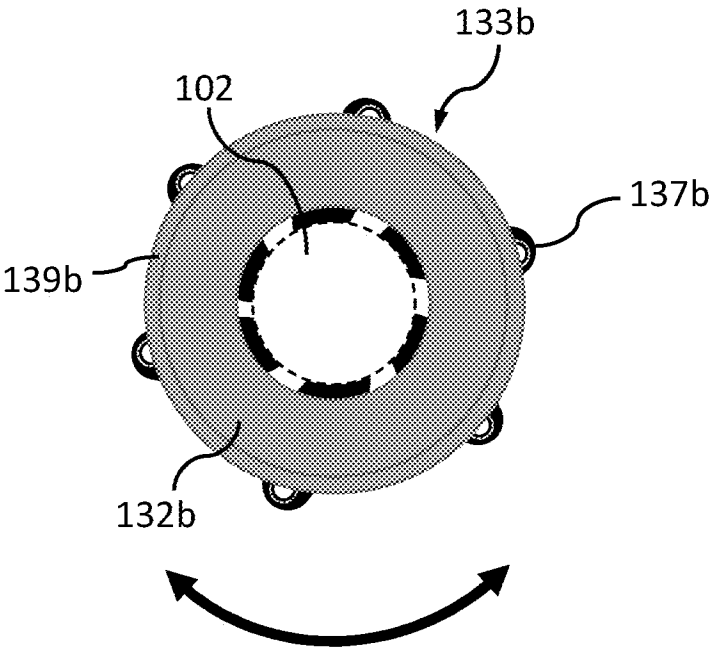
Figure 4A:
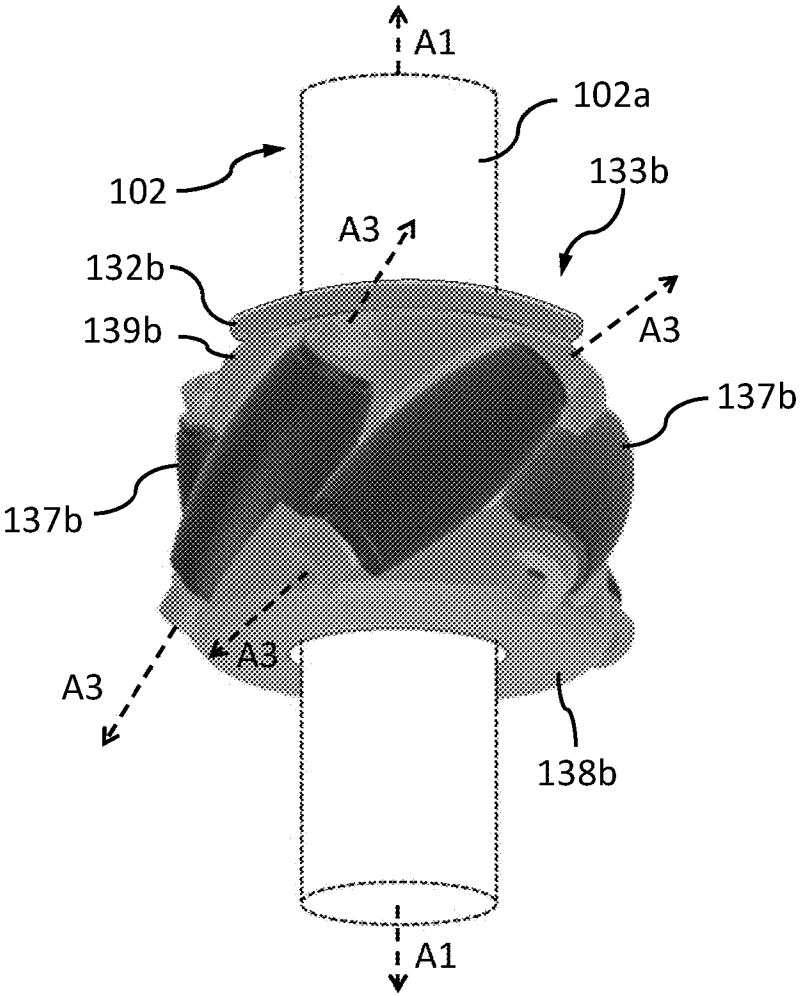
Figure 5B:
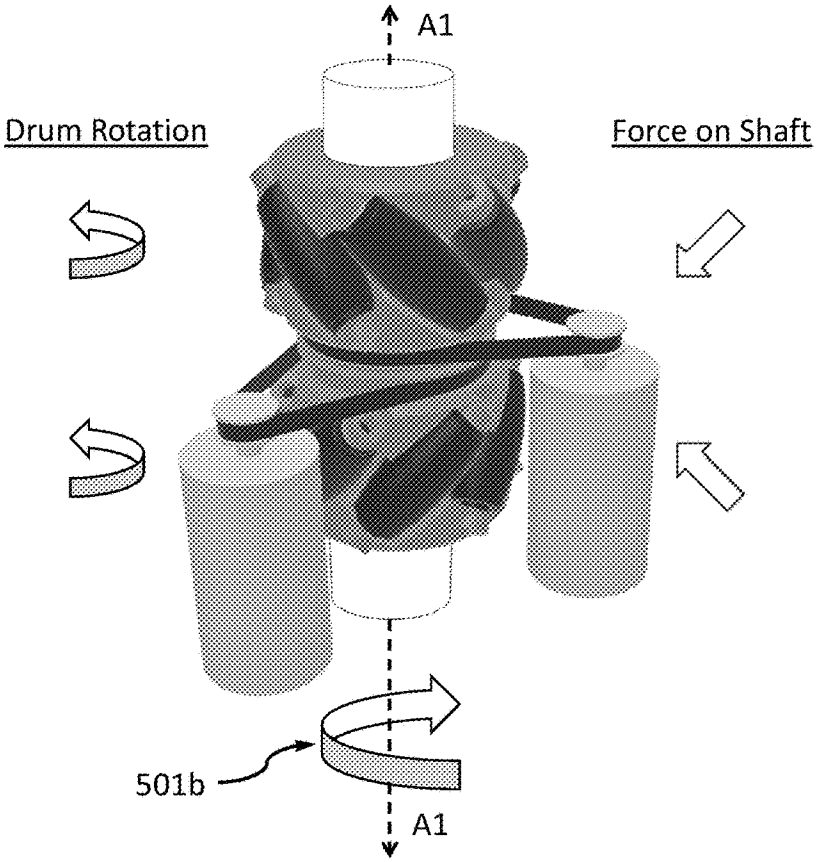
Figure 5A:
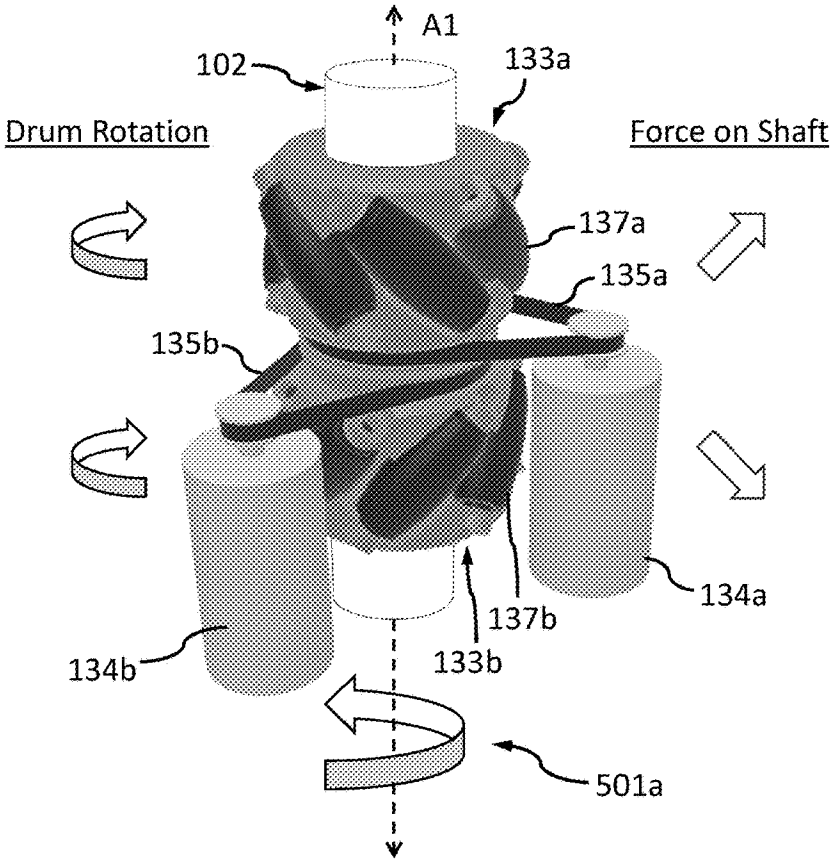
Figure 6B:
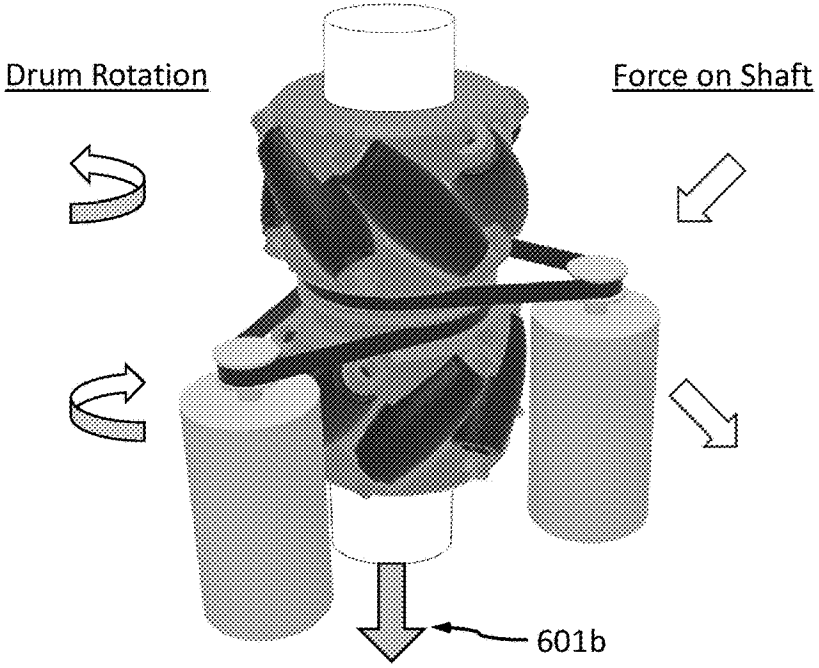
Figure 6A:
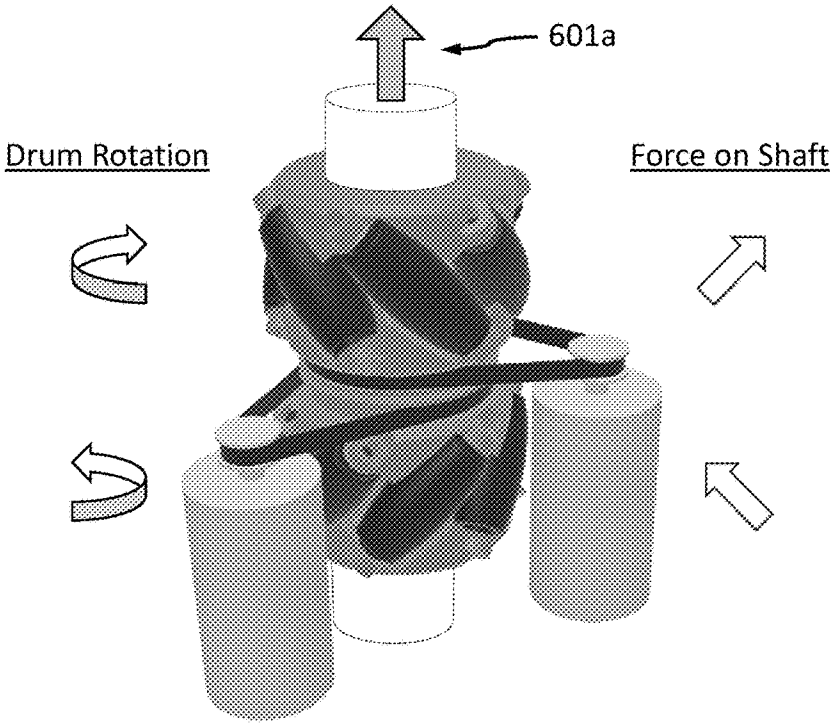
Figure 9:
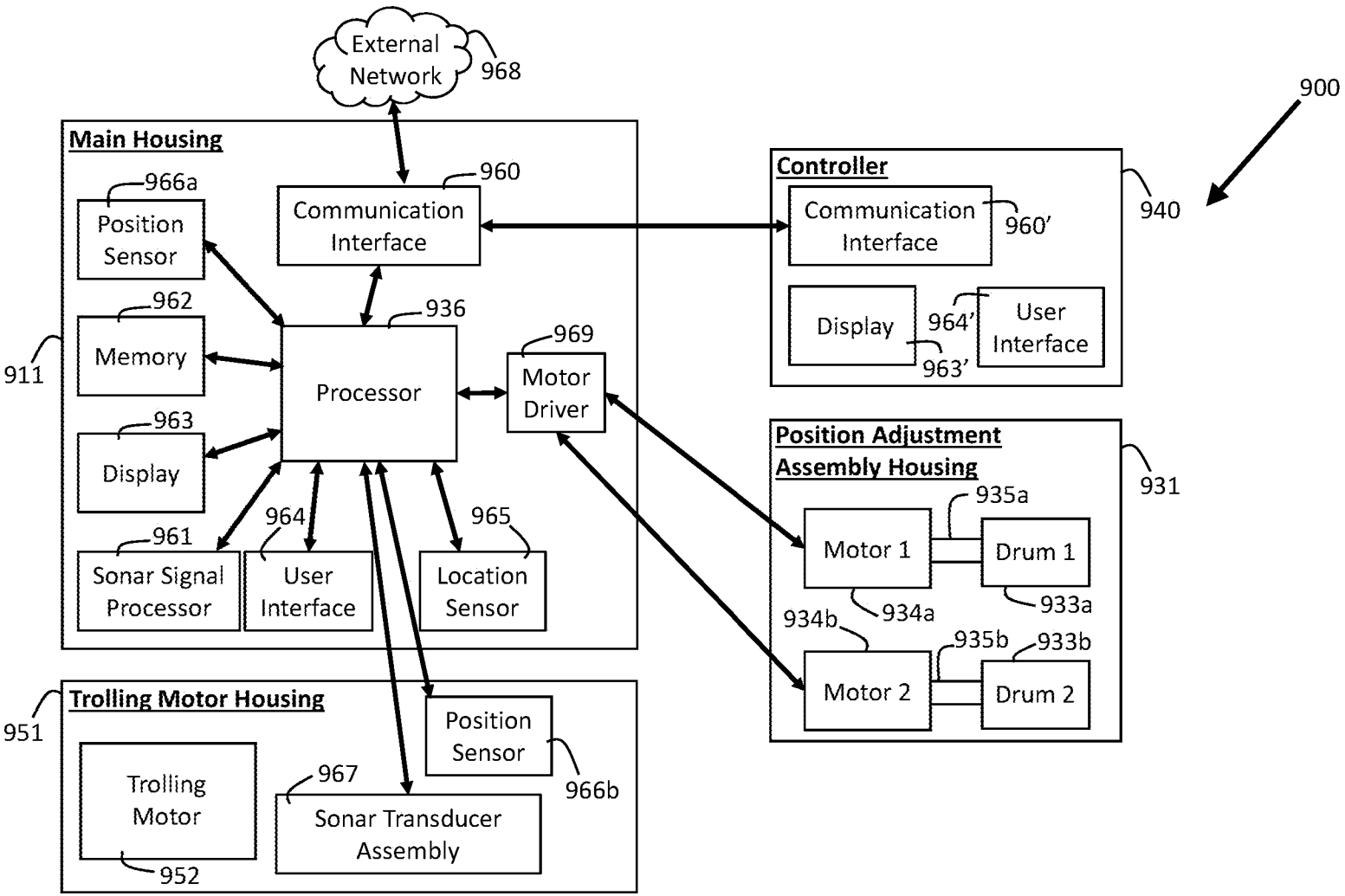
Figure 10:
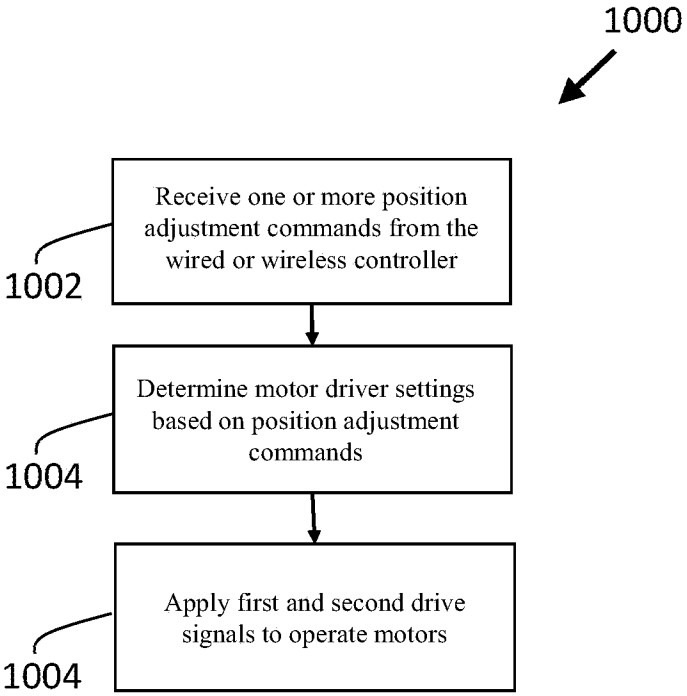

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 shows an example trolling motor system including an example position adjustment assembly in accordance with some embodiments discussed herein;

FIGS. 3A and 3B illustrate a portion of the position adjustment assembly of FIG. 2, in accordance with some embodiments discussed herein;

FIGS. 4A and 4B illustrate another portion of the position adjustment assembly of FIG. 2, in accordance with some embodiments discussed herein;

FIGS. 5A and 5B schematically depict operation of the position adjustment assembly of FIG. 2 to adjust the rotational position of a trolling motor, in accordance with some embodiments discussed herein;

FIGS. 6A and 6B schematically depict operation of the position adjustment assembly of FIG. 2 to adjust the vertical position of a trolling motor, in accordance with some embodiments discussed herein;

FIGS. 7A-D schematically depict operation of the position adjustment assembly of FIG. 2 to adjust the rotational and vertical positions of a trolling motor, in accordance with some embodiments discussed herein;

FIGS. 8A-D schematically depict operation of the position adjustment assembly of FIG. 2 to adjust the rotational and vertical positions of a trolling motor, in accordance with some embodiments discussed herein;

FIG. 9 shows a block diagram illustrating a trolling motor system including an example trolling motor assembly with a position adjustment assembly, in accordance with some embodiments discussed herein; and FIG. 10 illustrates a flowchart of an example method for operating a position adjustment assembly according to some embodiments discussed herein.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein; rather, these embodiments are provided so that this disclosure will satisfy applicable legal requirements. Like reference numerals refer to like elements throughout.

In accordance with various aspects of the present teachings, systems, assemblies, and methods are provided herein to independently or simultaneously rotate and vertically adjust a marine device such as a trolling motor or sensor device (e.g., sonar transducer(s)) that is coupled to the end of a shaft by rotating the marine device about the central axis of the shaft and/or by translating the marine device along the central axis of the shaft. Though such position adjustment assemblies are generally described herein with reference to electronically controlling the position of a watercraft's trolling motor, a person skilled in the art will appreciate that the present teachings may be utilized to adjust the angular and/or vertical position of a variety of devices coupled to a shaft, for example, within a marine environment.

FIG. 1 illustrates an example watercraft 10 on a body of water 15. The watercraft 10 has a trolling motor assembly 20 attached to its front, with a trolling motor 50 submerged in the body of water. The trolling motor 50, which may be gas-powered or electric, for example, may be used as a propulsion system to provide thrust so as to cause the watercraft 10 to travel along the surface of the water. While the depicted embodiment shows the trolling motor assembly 20 attached to the front of the watercraft 10 and as a secondary propulsion system, example embodiments described herein contemplate that the trolling motor assembly 20 may be attached in any position on the watercraft 10 and/or may serve as the primary propulsion system for the watercraft 10.

In accordance with various aspects of the present teachings, the trolling motor assembly 20 depicted in the example embodiment of FIG. 1 includes a position adjustment assembly 30 for changing the angular orientation of the trolling motor 50 so as to change the direction of the trolling motor's thrust. That is, actuation of the position adjustment assembly 30 can be effective to rotate the trolling motor 50 clockwise and counterclockwise as indicated by the curved arrow (e.g., about an axis A1 that is substantially perpendicular to the direction of thrust) in order to change the direction of the thrust, and thus steer the watercraft. Additionally or alternatively, for example, depending on the desired position adjustment, the position adjustment assembly 30 can be effective to translate the trolling motor 50 up and down along axis A1 as indicated by the double-headed arrow so as to change the depth of the trolling motor 50 under the surface of the water 15.

As discussed in detail below, embodiments of position adjustment assemblies in accordance with the present teaching can also comprise a position adjustment assembly control system for providing control over the position of the trolling motor 50 (e.g., the direction of thrust, the depth of the trolling motor, etc.) based on commands received at a wired or wireless control so as to enable a user to direct the trolling motor 50 to move (e.g., rotate, translate) in a desired direction. By way of non-limiting example, the wired or wireless control can be a wired foot pedal, a wired/wireless marine electronic device (e.g., multi-functional display), and/or a wireless remote control. Additionally, electronically-controlled trolling motor assemblies in accordance with the present teachings can, in connection with a location sensor such as a global position system (GPS) sensor, allow for autonomous operation of the trolling motor (e.g., to automatically follow a pre-defined path) and/or deploy a "virtual anchor" that automatically adjusts the direction and force of the trolling motor 50 to maintain the watercraft in a substantially fixed position. Likewise, a sensor (e.g., depth finder, sonar, optical sensor) for detecting objects in the water and/or the depth of the water can allow for electronically-controlled trolling motor assemblies in accordance with the present teachings to automatically raise or lower the trolling motor 50, such as to avoid underwater collisions and/or fouling of the propeller.

FIG. 2 illustrates an example electric trolling motor assembly 100 comprising a position adjustment assembly 130 that may be actuated to direct the trolling motor 150 to move (e.g., rotate, translate) in a direction as indicated by position adjustment commands input at the foot pedal assembly 140 and/or remote control 145, as otherwise discussed herein. As shown, the trolling motor assembly 100 includes an elongate shaft 102 extending along an axis A1 between a first end 104 and a second end 106, a trolling motor housing 151, a main housing 111, and a position adjustment assembly housing 131 that at least partially contains two rotatable drums 133*a,b* surrounding the shaft 102. As discussed in additional detail with respect to FIG. 3, each of the rotatable drums 133*a,b* is operatively coupled to a respective motor 134*a,b* such that operation of each motor is effective to rotate the respective drum 133*a,b* about the shaft 102 in two circumferential directions (e.g., clockwise and counterclockwise). For example, as shown in FIG. 2, the motors 134*a,b* are operatively coupled to the rotatable drums 133*a,b* via a respective drive belt 135*a,b*. In various aspects, a seal may be formed with the shaft 102, for example, via O-rings 105*a,b* at the through holes 107*a,b* in the position adjustment assembly housing 131 through which the shaft 102 extends to prevent water from entering the housing 131.

Although at least a portion of the position adjustment assembly 130 is depicted in FIG. 2 as being contained within a separate housing 131 (e.g., the rotatable drums 133*a,b*), it will be appreciated that all or a portion of the position adjustment assembly 130 may instead be contained within the trolling motor housing 151 or the main housing 111, for example. Similarly, it will be appreciated that various components of position adjustment assemblies in accordance with various aspects of the present teachings (e.g., motors 134*a,b*, drive belts 135*a,b*, and a processor 136) may be disposed at various locations within the trolling motor assembly 100. By way of non-limiting example, though a position adjustment assembly control system of the position adjustment assembly 130 is depicted in the FIG. 2 as comprising a processor 136 disposed within the main housing 111, the processor 136 of the position adjustment assembly control system may instead be disposed in the position adjustment assembly housing 131, by way of non-limiting example.

As depicted in FIG. 2, the trolling motor housing 151 is attached to the second end 106 of the shaft 102 and at least partially contains a propulsion motor 152, or trolling motor, that connects to a propeller 153. Accordingly, when the trolling motor assembly 100 is attached to the watercraft and the propulsion motor 152 (or trolling motor) is submerged in the water, the propulsion motor 152 is configured to propel the watercraft to travel along the body of water as shown in FIG. 1. In addition to containing the propulsion motor 152, the trolling motor housing 151 may include other components such as, for example, a sonar transducer assembly and/or other sensors or features (e.g., lights, temperature sensors, etc.).

With reference again to FIG. 2, the main housing 111 is connected to the shaft 102 proximate the first end 104 of the shaft 102 and can, in some embodiments, include a handle such as hand control rod 114 that enables mechanical steering of the propulsion motor 152 by a user (e.g., through angular rotation about axis A1) and/or moving the trolling motor assembly 100 to and from a stowed configuration.

As shown, the trolling motor assembly 100 may also include an attachment device 127 (e.g., a clamp, a mount, or a plurality of fasteners) to enable connection or attachment of the trolling motor assembly 100 to the watercraft. Depending on the attachment device used, the trolling motor assembly 100 may be configured for rotational movement relative to the watercraft about the shaft's axis A1, including, for example, 360 degree rotational movement.

In some embodiments, when the trolling motor assembly 100 is attached to the watercraft and the propulsion motor 152 is submerged in the water, the main housing 111 may be positioned out of the body of water and visible/accessible by a user. The main housing 111 may be configured to house components of the trolling motor assembly 100, such as may be used for processing marine data and/or controlling operation of the trolling motor 152 and/or position adjustment assembly 130, among other things. For example, depending on the configuration and features of the trolling motor assembly, the trolling motor assembly 100 may contain, for example, one or more of a processor 136, a sonar assembly, memory, a communication interface, an autopilot navigation assembly, a speed actuator, and a steering actuator for the propulsion motor.

As noted above, the depicted example embodiment also includes a foot pedal assembly 140 that is enabled to control operation of the trolling motor assembly 100 and/or the position adjustment assembly 130. Depending on its configuration, the foot pedal assembly 140 may include an electrical plug 141 that can be connected to an external power source. As otherwise discussed herein, the foot pedal assembly 140 may be electrically connected to the propulsion motor 152 and/or the motors 134*a,b* (such as through the main housing 111) using a cable 142 (although it could be connected wirelessly) to enable a user to operate the trolling motor assembly 100 to control the speed of the watercraft and/or the position adjustment assembly 130 to adjust the direction of travel of the watercraft through controlling the angular orientation of the propulsion motor 152 relative to the shaft's axis A1. Additionally, in certain aspects, the foot pedal assembly 140 may be electrically connected to the motors 134*a,b* to enable a user to operate the position adjustment assembly 130 to adjust the vertical position of the trolling motor housing 151 within the water (e.g., the depth of the trolling motor housing 151) by translating the motor housing 151 up or down along axis A1.

For example, the processor 136 associated with the position adjustment assembly 130 may receive one or more position adjustment commands (e.g., a steering command, a vertical position command) from the foot pedal assembly 140, and based thereon, determine the drive signals to be applied to each of the motors 134*a,b* to cause coordinated rotation of the respective drums 133*a,b* in a given circumferential direction, speed of rotation, and/or total length of rotation necessary to obtain the desired angular and/or vertical position of the trolling motor housing 151 indicated by the position adjustment command(s).

In an example embodiment, the user may actuate the foot pedal assembly 140 to provide a position adjustment command in which the user wishes to steer the trolling motor while maintaining the vertical position of the trolling motor housing 151, which in turn may be used to cause the position adjustment assembly 130 to rotate the trolling motor housing 151 about axis A1 to a desired orientation. For example, the depicted foot pedal assembly 140 can include a pedal configured to be pivoted with a user's foot (e.g., toes and/or heel) from a default position shown in FIG. 2 (e.g., a position which causes the trolling motor housing 151 to be oriented such that propulsion causes the boat to go straight forward) so as to cause the trolling motor housing 151 to rotate. In some embodiments, pivoting the pedal in a first direction (e.g., when the user applies toe-down pressure on the pedal) may cause the trolling motor housing 151 to rotate about axis A1 in a clockwise direction, while pivoting the pedal in a second direction (e.g., when the user applies heel-down pressure on the pedal) instead causes the trolling motor housing 151 to rotate in a counterclockwise direction. In some such embodiments, for example, if the user toe-presses the pedal to rotate the trolling motor housing 151 in a clockwise direction, the position adjustment assembly's processor 136 may receive an electrical signal from the pedal assembly 140 (e.g., via cable 142) and determine therefrom the coordinated rotation of the drums 133*a,b* necessary to obtain the desired clockwise rotation of the trolling motor housing 151. Alternatively, for example, if the user heel-presses the pedal to rotate the trolling motor housing 151 in a counterclockwise direction, the position adjustment assembly's processor 136 may receive an electrical signal from the pedal assembly 140 (e.g., via cable 142) and determine therefrom the necessary direction of rotation of the drums 133*a,b* in order to obtain the desired counterclockwise rotation of the trolling motor housing 151.

While the above description details use of a foot pedal, other user input assemblies are contemplated for controlling the steering direction of the trolling motor.

Additionally or alternatively, position adjustment assemblies in accordance with the present teachings may be configured to adjust the vertical position of the trolling motor housing 151. For example, a user may actuate the foot pedal assembly 140, for example, by depressing another button (not shown) on foot pedal assembly 140 to provide a position adjustment command in which the user wishes to increase or decrease the depth of the trolling motor housing 151, while maintaining the same angular orientation relative to axis A1, which in turn may be used to cause the position adjustment assembly to translate the trolling motor housing 151 along axis A1 to a desired vertical position.

In some embodiments, depressing a button on the foot pedal assembly 140 may cause the trolling motor housing 151 to translate along axis A1 upwards (e.g., the trolling motor housing 151 becomes more shallow), while depressing another button on the foot pedal assembly 140 may instead cause the trolling motor housing 151 to translate along axis A1 downwards (e.g., the trolling motor housing 151 is positioned deeper). In some such embodiments, for example, the position adjustment assembly's processor 136 may receive an electrical signal from the pedal assembly 140 (e.g., via cable 142) and determine therefrom the necessary direction of rotation for each of the drums 133*a,b* in order to obtain the desired vertical positioning of the trolling motor housing 151.

While the above description details use of a button, other user input assemblies are contemplated for controlling the vertical position of the trolling motor. For example, the angular position of the foot pedal (e.g., normally used for commanding steering direction of the trolling motor), may be used instead for controlling the vertical position of the trolling motor.

Coordinated actuation of the rotatable drums 133*a,b* of the position adjustment assembly 130 may not only cause angular rotation of the trolling motor housing 151 (e.g., without changing its vertical position) or cause vertical translation of the trolling motor housing 151 (e.g., without changing its angular orientation) as discussed above, but may further provide simultaneous adjustments to both the angular and vertical position of the trolling motor housing 151. For example, a user may toe or heel press the foot pedal assembly as well as depress a button such that the position adjustment assembly 130 causes the trolling motor housing 151 to simultaneously rotate (clockwise or counterclockwise) and translate (move up or down). As discussed in detail below, the processor 136 may provide drive signals to each of the motors 134*a,b* so as to cause the trolling motor housing 151 to simultaneously move clockwise/up, clockwise/down, counterclockwise/up, or counterclockwise/down.

In various aspects, the target speed of rotation and/or translation may be commanded by the position adjustment command and determined by the processor 136 or may be determined to be a default speed, for example, to provide for efficient operation of the motors 134*a,b*. The processor 136 may cause a motor driver circuit to apply a drive signal to the poles of the motors 134*a,b* to cause rotation of the respective drums 133*a,b* in accordance with the appropriate settings, thereby rotating and/or translating the trolling motor housing 151 in the desired direction. In some embodiments, the position adjustment command may indicate a desired final angular or vertical position of the trolling motor housing 151 or alternatively, as in the example above, drive signals may be continuously applied to the motors 134*a,b* to rotate and/or translate the trolling motor housing 151 in the indicated direction, for example, until the user releases pressure on the pedal and/or button of the pedal assembly 140.

As depicted in FIG. 2, the trolling motor assembly 100 may, in some embodiments, additionally or alternatively include a handheld remote control 145 that may be wired or wirelessly connected to the main housing 111 to provide position adjustment commands, similar to the commands discussed above with reference to the foot pedal assembly 140. The handheld control 145 may be a dedicated control or may be a control interface executed on a user device (e.g., a tablet computer, smart phone, or the like), a marine electronic device of the watercraft, or other remote operating device.

Moreover, in certain embodiments, the trolling motor assembly 100 can be enabled to utilize a location sensor, such as a global position system (GPS) sensor configured to determine a current location of the watercraft 10 (or the trolling motor assembly 100 mounted thereto), to generate position adjustment commands that enable the watercraft to be steered to follow a pre-programmed path, repeat a path previously traversed, or maintain the watercraft in a substantially fixed position. In such example embodiments, the processor 136 may be in communication with or include a location sensor. Upon receipt of a position lock command, such as from the foot pedal assembly 140 or handheld control 145, the processor 136 may determine a first location based on location data from the location sensor and cause the trolling motor assembly 100 to maintain a location of the watercraft 10 within a predetermined threshold distance of the first location, such as 5 ft., 10 ft., or other suitable distance. For example, the processor 136 may automatically generate one or more position adjustment commands to cause the trolling motor housing 151 to be angularly-positioned to the desired direction to maintain the location of the watercraft 10 within the predetermined threshold distance. Additionally, a processor (the same or different processor as processor 136) may cause the trolling motor 152 to be energized and de-energized to propel the watercraft 10 in the desired direction with the desired thrust. While the virtual anchor or position lock feature is described above, other features, such as maintaining a heading, going to a waypoint, creating a waypoint, etc. are also contemplated herein.

Additionally, in certain embodiments, the trolling motor assembly 100 can be enabled to utilize a sensor configured to detect objects in the water and/or the depth of the water to generate position adjustment commands that enable the vertical position of the trolling motor housing 150 to be automatically adjusted (e.g., without interaction by the user). By way of example, a location sensor could indicate a current location of the watercraft 10 such that known depth contours of the body of water may generate position adjustment commands that cause the trolling motor housing 150 to be raised, such as to avoid running aground or hitting a rock/structure. Similarly, sonar or optical sensors, by way of non-limiting example, could be used to determine the depth of the water and/or the presence of an object (e.g., an anchor or fishing trap line, weeds) near the surface of the water such that the trolling motor housing 150 is raised or lowered to avoid underwater collisions and/or fouling the propeller 153.

With reference now to FIGS. 3A-8D, a portion of the example position adjustment assembly 130 of FIG. 2 is shown in additional detail. With reference first to FIGS. 3A-B, the upper rotatable drum 133*a* comprises a through hole through which shaft 102 extends (e.g., along axis A1 of FIG. 2). A plurality of rollers 137*a* diagonally extend between an upper flange 138*a* and a lower flange 139*a* of the drum 133*a* and are rotatably coupled thereto, for example, at bearings. For example, as depicted in FIG. 3A, each of the rollers 137*a* generally extends along a respective axis A2 and is configured to rotate thereabout while coupled to the flanges 138*a*, 139*a* of drum 133*a*. As shown, the drum 133*a* comprises six rollers 137*a* disposed circumferentially about the perimeter of the drum 133*a*, though one skilled in the art will appreciate that any number of a plurality of rollers 137*a* may be utilized in accordance with the present teachings.

The rollers 137*a* can have a variety of shapes but are generally configured such that a portion of each roller 137*a* extends radially into the through hole of the drum 133*a* so as to be disposed in contact with an outer surface 102*a* of the shaft 102, as best shown in the top view of FIG. 3B. The rollers 137*a* may have a variety of lengths. For example, as shown in FIG. 3A, the rollers 137*a* exhibit a length and are disposed at an angle such that each roller 137*a* begins at the same circumferential position where the adjacent roller 137*a* ends. However, in various aspects, the rollers 137*a* may circumferentially overlap adjacent rollers or may be arranged so as to be separated by a circumferential distance from one another. The rollers 137*a* can be formed from variety of materials, though in some example embodiments, may be formed of a resilient material (e.g., an elastic material such as rubber) that is configured to deform when disposed in contact with the shaft 102.

As will be appreciated by a person skilled in the art, each of the respective axes A2 of the rollers 137*a* depicted in FIG. 3A are skewed relative to one another, and further, project onto the central axis A1 at the same angle. As discussed in detail below, the projected angle formed between axes A2 and the central axis A1 may be at a variety of angles but generally is oblique (e.g., not parallel or perpendicular) such that each of rollers 137*a* are diagonally disposed relative to the central axis A1.

As indicated by the arrow in FIG. 3B, the drum 133*a* may be caused to rotate about the shaft 102 in two circumferential directions (e.g., clockwise and counterclockwise) via a motor (e.g., motor 134*a* of FIG. 2) operatively coupled to a pulley 132*a* of the drum 133*a* via a drive belt (e.g., belt 135*a* of FIG. 2). When the motor causes the drum 133*a* to rotate clockwise when viewed from the perspective of FIGS. 3A and 3B, for example, the rollers 137*a* which are coupled thereto, likewise translate along the clockwise circumferential path. Frictional forces between the rollers 137*a* and the outer surface 102*a* of the shaft 102 during such clockwise rotation of the drum 133*a* also cause the rollers 137*a* to rotate about their respective axes A2 in a clockwise direction. Because the rollers 137*a* are disposed at an oblique angle relative to the shaft 102, an equal and opposite force is applied to the shaft 102 through contact with each roller 137*a* as it rotates clockwise about its respective axis A2. That is, the force applied to the shaft 102 is perpendicular to the axis A2, having both a vertical component (upwards in FIG. 3A) and a circumferential component (counterclockwise in FIG. 3A). On the other hand, when the drum 133*a* is caused to rotate in the other circumferential direction (i.e., counterclockwise), the rollers 137*a* translate along the counterclockwise circumferential path, thereby causing rotation of the rollers 137*a* about their axes A2 in a counterclockwise direction and a force on the shaft 102 in the opposite direction relative to that caused by rotation of the drum 133*a* in the clockwise direction. That is, counterclockwise rotation of the drum 133*a* as depicted in FIG. 3A would produce a force on the shaft 102 having both a downwards vertical component and a clockwise circumferential component.

With reference now to FIGS. 4A-B, the lower rotatable drum 133*b* of FIG. 2 is depicted. As shown, the rotatable drum 133*b* is similar to drum 133*a* discussed above, but differs in that the rollers 137*b*, which are rotatably coupled between the upper flange 139*b* and the lower flange 138*b*, extend along respective axes A3 that project onto the central axis A1 at a different orientation relative to the projection of axes A2. That is, the projected angle formed between axes A3 and the central axis A1 is oblique (e.g., not parallel or perpendicular) such that each of rollers 137*b* are diagonally disposed relative to the central axis A1 in an opposite direction relative to rollers 137*a*. Indeed, it will be appreciated that the drums 133*a,b* may be substantially identical, except their orientation on the shaft 102 being inverted relative to one another such that the rollers 137*a,b* are diagonally disposed in opposite directions.

Like drum 133*a* of FIGS. 3A-B, drum 133*b* is also configured to rotate about the shaft 102 in two circumferential directions (e.g., clockwise and counterclockwise) as indicated by the arrow in FIG. 4B. In particular, when the drum 133*b* rotates clockwise when viewed from the perspective of FIGS. 4A and 4B, the rollers 137*b* which are coupled thereto, likewise translate along the clockwise circumferential path. Frictional forces between the rollers 137*b* and the outer surface 102*a* of the shaft 102 during such clockwise rotation of the drum 133*b* cause the rollers 137*b* to rotate about their respective axes A3 in a clockwise direction. As a result of the oblique angle of rollers 137*b* relative to the shaft 102, the equal and opposite force applied to the shaft 102 through contact with each roller 137*b* as it rotates clockwise about its respective axis A3 is perpendicular to axis A3, thus providing a downward vertical component and a counterclockwise circumferential component as viewed from the perspective of FIG. 4A. On the other hand, when the drum 133*b* rotates counterclockwise, the rollers 137*b* rotate about their axes A3 in a counterclockwise direction and apply a force on the shaft 102 in the opposite direction relative to that caused by rotation of the drum 133*b* in the clockwise direction. That is, counterclockwise rotation of the drum 133*b* as depicted in FIG. 4B would produce a force on the shaft 102 having both a upwards vertical component and a clockwise circumferential component.

As noted above, the rollers 137*a,b* of the respective drums are diagonally disposed in opposite directions relative to the central axis A1 such that simultaneous rotation of the drums 133*a,b* in the same circumferential direction results in different directional forces to be applied to the shaft 102 by each of the respective groups of rollers 137*a,b*. The respective longitudinal axes A2 and A3 of rollers 137*a* can be disposed offset obliquely relative to the central axis A1 at a variety of angles. For example, as shown in FIGS. 3A and 4A, the respective longitudinal axes A2, A3 of the rollers 137*a,b* can be offset by about 45 degrees relative to the central axis A1 (e.g., −45 degrees for A2, +45 degrees for A3). However, in light of the teachings herein, it will be appreciated that smaller offsets in which A2 and A3 are more aligned with A1 may generate more circumferential force on the shaft 102 relative to the vertical force for a given rotation of the drums 133*a,b*. Likewise, a larger offset (e.g., when A2 and A3 are closer to perpendicular relative to A1) may be used if one wishes to generate relatively more vertical force on the shaft 102 for a given rotation of the drums 133*a,b*.

With reference now to FIGS. 5A and 5B, an example of coordinated operation of the drums 133*a,b* is schematically depicted as providing rotational motion of the shaft 102, for example, without adjusting the vertical position of the trolling motor or other marine device coupled thereto through the selective circumferential rotation of the drums 133*a,b* at the same rotational speed. As shown, each of drums 133*a,b* is operatively coupled to a respective motor 134*a,b* via one or more motors, gears, belt drive, etc. (e.g., a respective drive belt 135*a,b*).

With reference first to FIG. 5A, the upper and lower drums 133*a,b* are shown as both being caused to rotate clockwise under the influence of respective motors 134*a*, 134*b* at the same speed. As a result of the clockwise rotation of upper drum 133*a*, for example, the rollers 137*a* produce a force on the shaft 102 upward and counterclockwise (to the right in the plane of the paper). On the other hand, the same clockwise rotation of lower drum 133*b* causes the rollers 137*b* to produce a force on the shaft 102 downward and counterclockwise. Summing the respective vertical and circumferential component forces on the shaft 102 provides the total force acting on the shaft 102. As indicated by the arrows representing the forces on the shaft caused by rotation of each drum 133*a,b*, the magnitude of the respective forces on the shaft 102 may be identical while the direction of the forces differ. Where the opposite vertical components cancel one another out and the circumferential forces are in the same direction (e.g., to the right in FIG. 5A), simultaneous clockwise rotation of the drums 133*a,b* results in the shaft 102 rotating in a counterclockwise direction as indicated by the curved arrow 501*a* at the bottom of FIG. 5A.

FIG. 5B schematically depicts the resulting motion of the shaft 102 when the upper and lower drums 133*a,b* are both caused to instead rotate counterclockwise at the same speed (i.e., in the opposite directions relative to FIG. 5B). In this case, the rollers 137*a* of upper drum 133*a* produce a force on the shaft 102 downward and clockwise (to the left in the plane of the paper) while the rollers 137*b* of lower drum 133*b* produce a force on the shaft 102 upward and clockwise. Again, the vertical components of the forces on the shaft caused by circumferential rotation in the same direction cancel one another out such that simultaneous counterclockwise rotation of the drums 133*a,b* results in the shaft 102 rotating clockwise as indicated by the curved arrow 501*b* at the bottom of FIG. 5B. It will be appreciated that the interaction between the rollers 137*a,b* and the shaft 102 that cause vertically-directed force components on the shaft 102 would likewise generate vertical force components on the rollers 137*a,b* (and thus the drum) in the opposite directions. In various aspects, a horizontally-extending stop (not shown) may be formed (e.g., within the position adjustment assembly housing 131 of FIG. 2) so as to prevent vertical movement of the drums 133*a,b* during their circumferential rotation about shaft 102. By way of example, when the drums 133*a,b* substantially abut each other as shown in FIG. 5B (e.g., the drums 133*a,b* are stacked), such a stop may be configured to be in contact with an upper surface of upper drum 133*a* and the lower surface of drum 133*b* to prevent their upward or downward movement of the drums 133*a,b* respectively, while nonetheless allowing their circumferential rotation about the shaft 102. Alternatively, for example, when the drums 133*a,b* are separated by a distance along the axis A1, each drum 133*a,b* may be associated with an upper and lower stop to prevent such vertical movement.

With reference now to FIGS. 6A and 6B, an example of coordinated operation of the drums 133*a,b* is schematically depicted as providing vertical motion of the shaft 102, for example, without rotating the shaft 102 (or the trolling motor or other marine device coupled thereto). As shown in FIG. 6A, the upper drum 133*a* is caused to rotate clockwise while the lower drum 133*b* is caused to rotate counterclockwise at the same speed under the influence of their respective associated motors. As a result of the respective circumferential rotations, the rollers 137*a* produce a force on the shaft 102 upward and counterclockwise (to the right in the plane of the paper) and the rollers 137*b* produce a force on the shaft 102 upward and clockwise (to the left in the plane of the paper). Where the opposite circumferential force components are equal in magnitude but in opposite direction and the vertical force components are in the same direction (e.g., both upward in FIG. 6A), the sum of the forces on the shaft 102 caused by the depicted rotations of drums 133*a,b* results in the shaft 102 being pushed vertically up as indicated by the arrow 601*a* at the top of FIG. 6A. As discussed above, it will be appreciated that while the shaft 102 is being pushed vertically upward in FIG. 6A relative to drums 133*a,b*, the opposed vertical force components on rollers 137*a,b* (and thus on drums 133*a,b*) may be ineffective to push the drums 133*a,b* downward due to one or more stops (e.g., within the position adjustment assembly housing 131 of FIG. 2) that prevent vertical motion of the drums 133*a,b*.

FIG. 6B schematically depicts the resulting downward motion indicated by arrow 601*b* of the shaft 102 when each of the upper and lower drums 133*a,b* are caused to rotate in opposite directions relative to their respective rotation directions in FIG. 6A. In this case, the rollers 137*a* of upper drum 133*a* produce a force on the shaft 102 downward and clockwise, while the rollers 137*b* of lower drum 133*b* produce a force on the shaft 102 downward and counterclockwise. As in FIG. 6A, the opposite circumferential force components cancel each other out while the vertical force components together push the shaft 102 downward.

In addition to causing the shaft 102 (and thus the marine device coupled thereto) to only rotate (as in FIGS. 5A and 5B) or to only move vertically (as in FIGS. 6A and 6B), the coordinated rotation of the drums 133*a,b* in various directions and at various speeds can also cause simultaneous adjustments to both the rotation and vertical position of the shaft 102 in clockwise/up, clockwise/down, counterclockwise/up, or counterclockwise/down movements. For example, FIG. 7A depicts an example adjustment which the shaft 102 is caused to simultaneously rotate counterclockwise and translate vertically up. As with FIG. 5A, the drums 133*a,b* are both caused to rotate clockwise, although FIG. 7A differs in that the upper drum 133*a* rotates faster than drum 133*b*, thereby resulting in greater circumferential and vertical force components being applied to the shaft 102 by rollers 133*a* relative to that applied by rollers 133*b*. As in FIG. 5A, because the respective circumferential component forces on the shaft 102 are in the same direction (e.g., counterclockwise, to the right in FIG. 7A), the simultaneous clockwise rotation of the drums 133*a,b* results in the shaft 102 rotating in a counterclockwise direction as indicated by the curved arrow 701*a*. However, unlike in FIG. 5A in which the vertical force components are equal in magnitude and opposite direction, summation of the vertical force components in FIG. 7A results in a net force vertically upward as indicated by arrow 703*a* due to the increased magnitude of the vertical force component caused by the faster relative rotation of the upper drum 133*a*.

Figure 7B:
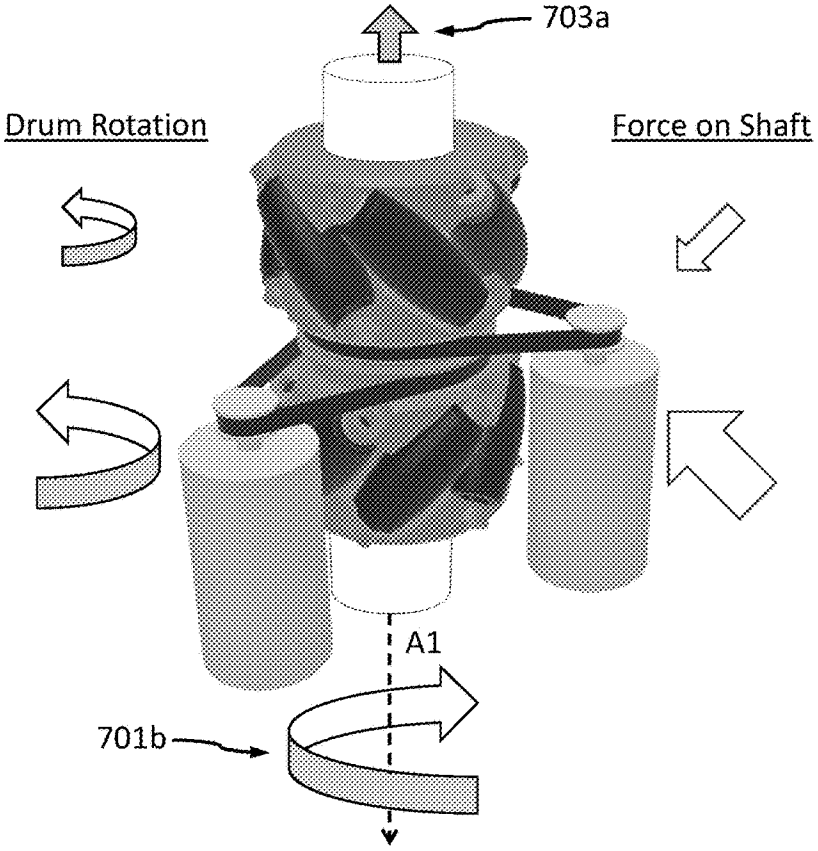
Figure 7A:
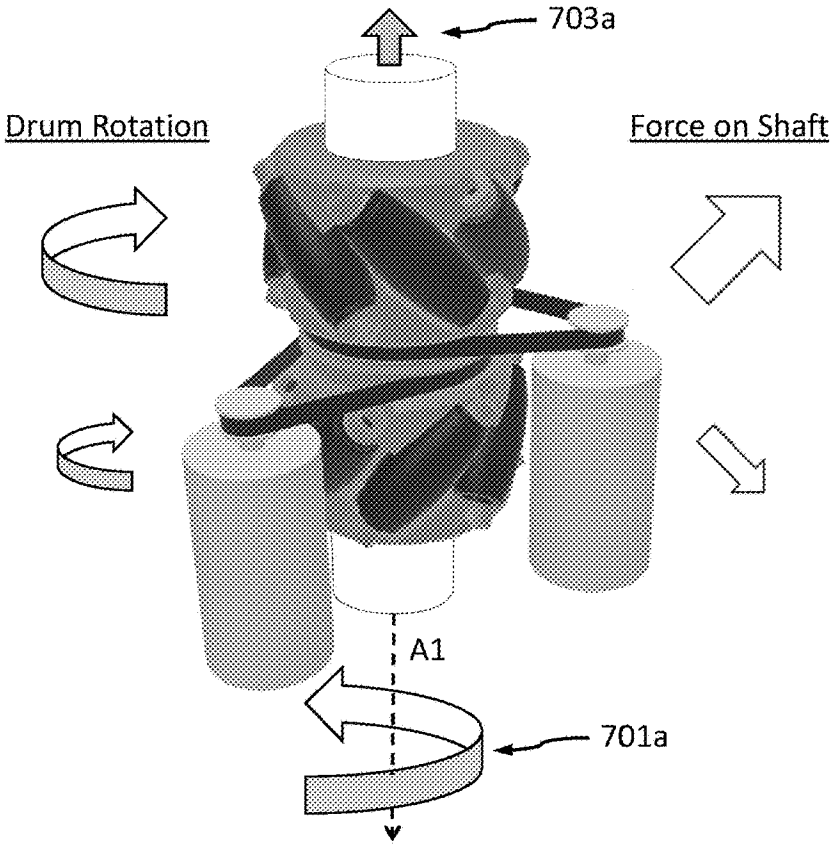

FIG. 7B depicts an example adjustment in which the shaft 102 is caused to not only rotate clockwise (as in FIG. 5B), but also translate upward by causing both drums 133*a,b* to rotate in the opposite direction (e.g., counterclockwise) relative to the drums' rotation in FIG. 7A. In particular, the drums 133*a,b* are both caused to rotate counterclockwise as in FIG. 5B, although in FIG. 7B the lower drum 133*b* rotates faster than the upper drum 133*a*, thereby resulting in greater circumferential and vertical force components being applied to the shaft 102 by rollers 133*b* relative to that applied by rollers 133*a*. As in FIG. 5B, because the respective circumferential component forces on the shaft 102 are in the same direction (e.g., clockwise, to the left in FIG. 7B), the simultaneous counterclockwise rotation of the drums 133*a,b* results in the shaft 102 rotating in a clockwise direction as indicated by the curved arrow 701*b*. However, unlike in FIG. 5B in which the opposed vertical force components are equal in magnitude, summation of the vertical force components in FIG. 7B results in a net force vertically upward as indicated by arrow 703*a* due to the increased magnitude of the vertical force component caused by the faster relative rotation of the lower drum 133*b*.

Figure 7D:
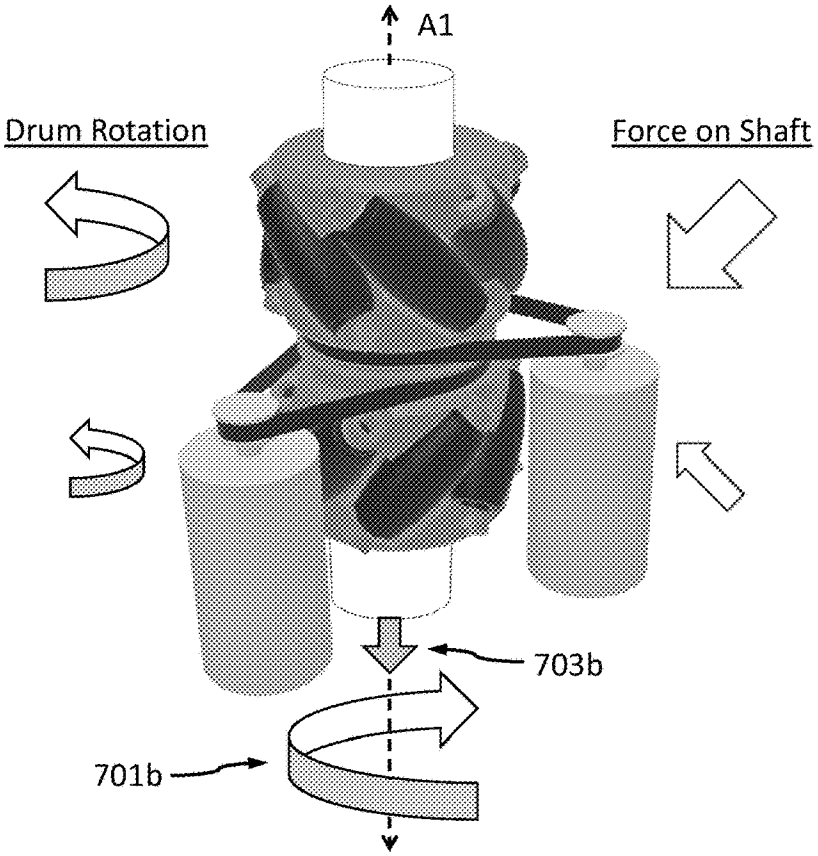
Figure 7C:
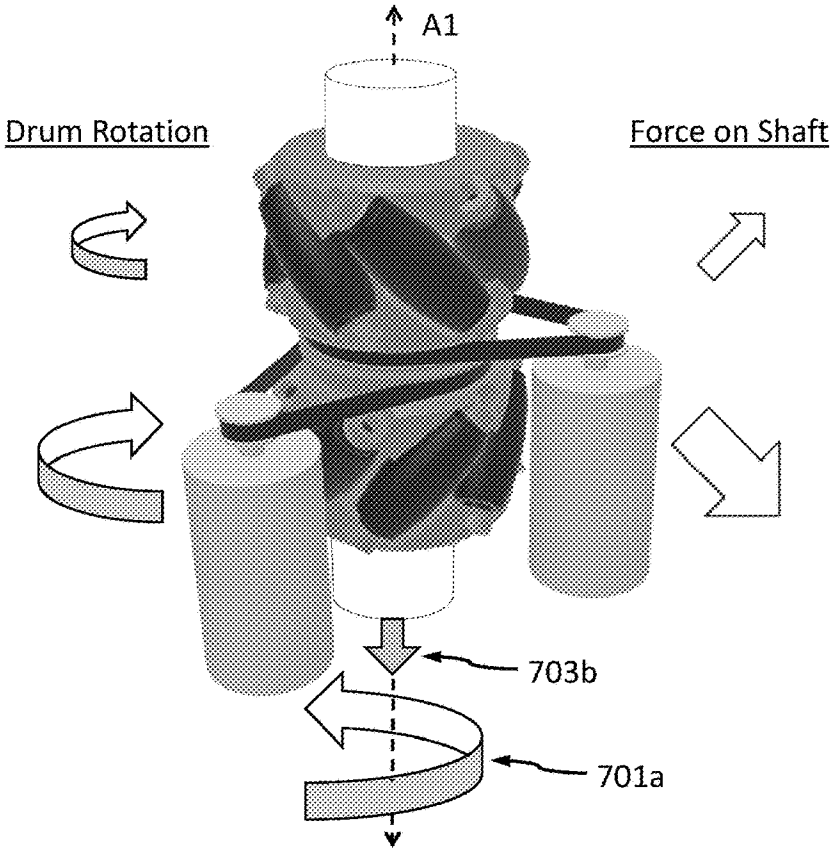

FIG. 7C depicts an example adjustment in which the shaft 102 is caused to rotate counterclockwise as in FIG. 7A (as indicated by arrow 701*a*). However, whereas the shaft 102 translates upward in FIG. 7A as indicated by arrow 703*a*, differential rotation of the drums 133*a,b* in FIG. 7C is effective to instead cause the shaft to translate downward as indicated by arrow 703*b*. In particular, the lower drum 133*b* rotates clockwise about the central axis A1 faster than the upper drum 133*a* rotates clockwise, thereby resulting in a circumferential force counterclockwise (as in FIG. 5A) as well as a net vertical force downward.

FIG. 7D depicts an example adjustment in which the shaft 102 is caused to rotate clockwise as in FIG. 7B (as indicated by arrow 701*a*). However, whereas the shaft 102 translates upward in FIG. 7B, differential counterclockwise rotation of the drums 133*a,b* in FIG. 7D is effective to cause the shaft 102 to instead translate downward as indicated by arrow 703*b* due to the increased rotation speed of the upper drum 133*a* relative to the lower drum 133*b*.

FIGS. 8A-D also depict example simultaneous adjustments to the rotation and vertical position of the shaft 102 due to differential rotation speeds between the upper drum 133*a* and the lower drum 133*b*. As in FIGS. 7A-D discussed above, the coordinated rotation of the drums 133*a,b* in FIGS. 8A-D may be effective to adjust the shaft 102 in clockwise/up, clockwise/down, counterclockwise/up, or counterclockwise/down directions. FIGS. 8A-D differ from FIGS. 7A-D, however, in that the drums 133*a,b* rotate in different circumferential directions relative to one another (e.g., one rotates clockwise and the other counterclockwise as in FIGS. 6A and 6B).

Figure 8B:
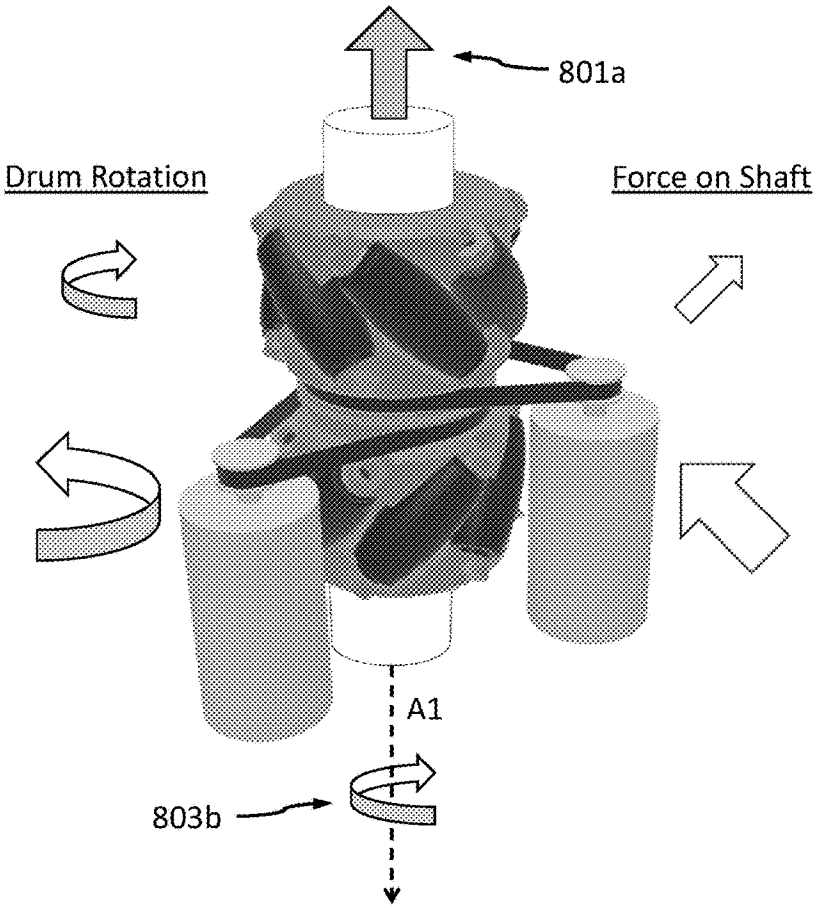
Figure 8A:
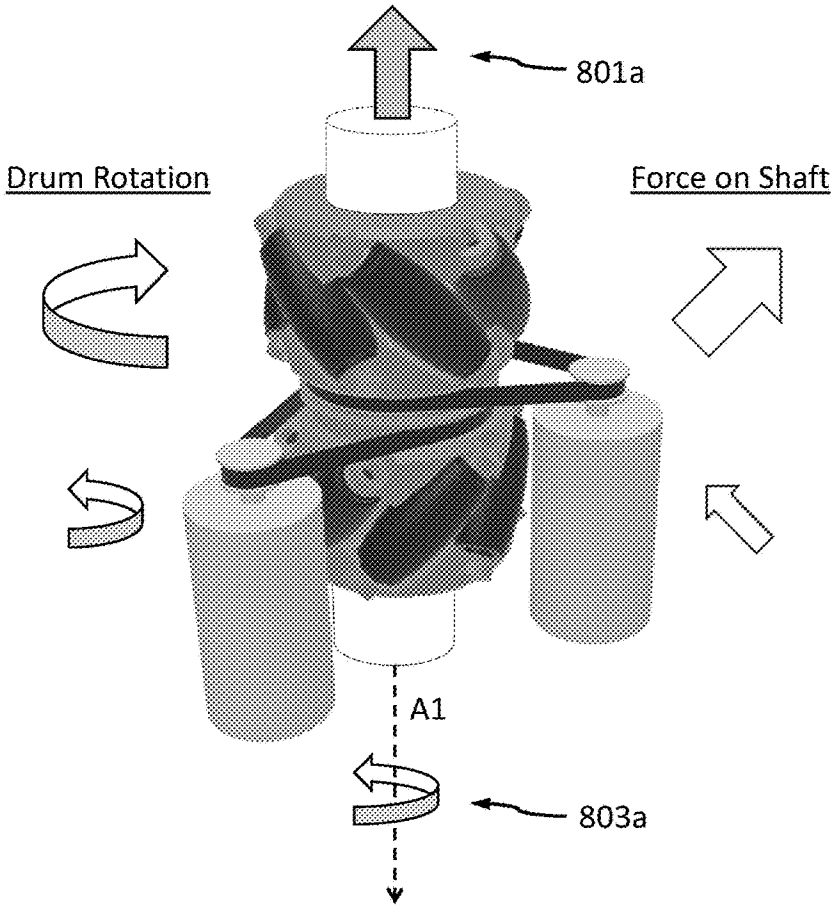

FIG. 8A, for example, depicts an example adjustment in which the shaft 102 is caused to not only translate upward (as in FIG. 6A), but also rotate counterclockwise. In particular, the upper drum 133*a* is caused to rotate clockwise at a higher rotation speed relative to the counterclockwise rotation of the lower drum 133*b*, thereby resulting in greater circumferential and vertical force components being applied to the shaft 102 by rollers 133*a* relative to that applied by rollers 133*b*. As in FIG. 6A, because the respective vertical forces on the shaft 102 are in the same direction (i.e., upward), the respective rotation of the drums 133*a,b* cause the shaft to move upward as indicated by arrow 801*a* in FIG. 8A. However, unlike in FIG. 6A in which the opposed circumferential force components are equal in magnitude due to identical rotation speeds between the drums 133*a,b*, summation of the circumferential force components in FIG. 8A results in a net counterclockwise force as indicated by arrow 803*a* due to the increased magnitude of the circumferential force component of drum 133*a*.

FIG. 8B depicts an example adjustment in which the shaft 102 is caused to simultaneously translate upward (as indicated by arrow 801*a*) and rotate clockwise (as indicated by arrow 803*b*). In particular, the relatively faster counterclockwise rotation of the lower drum 133*b* results in a net clockwise circumferential force.

Figure 8D:
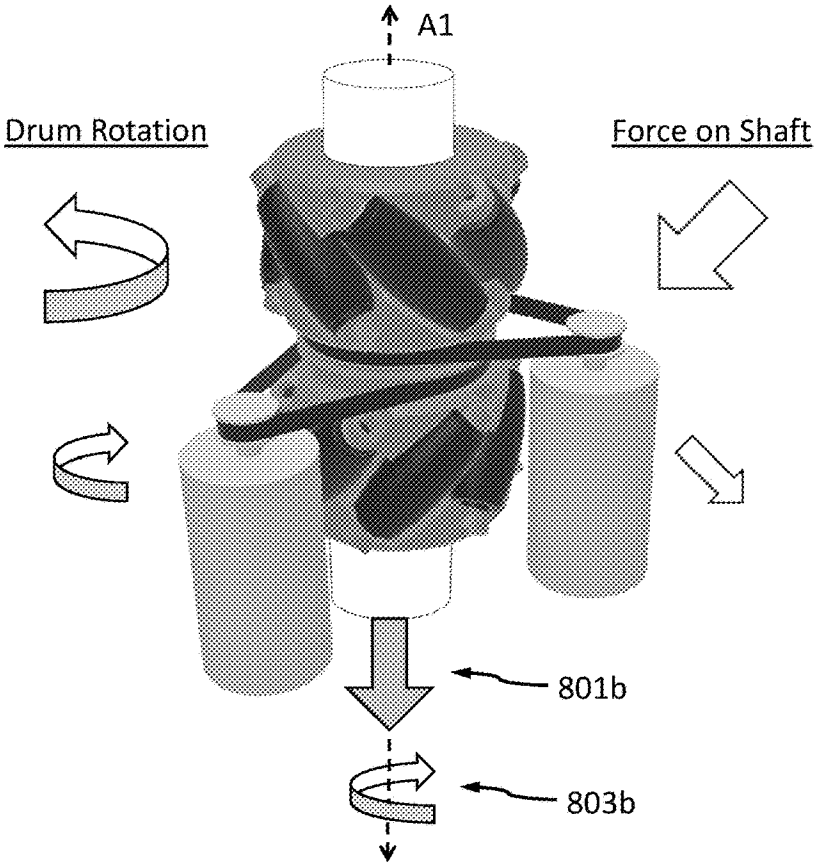
Figure 8C:
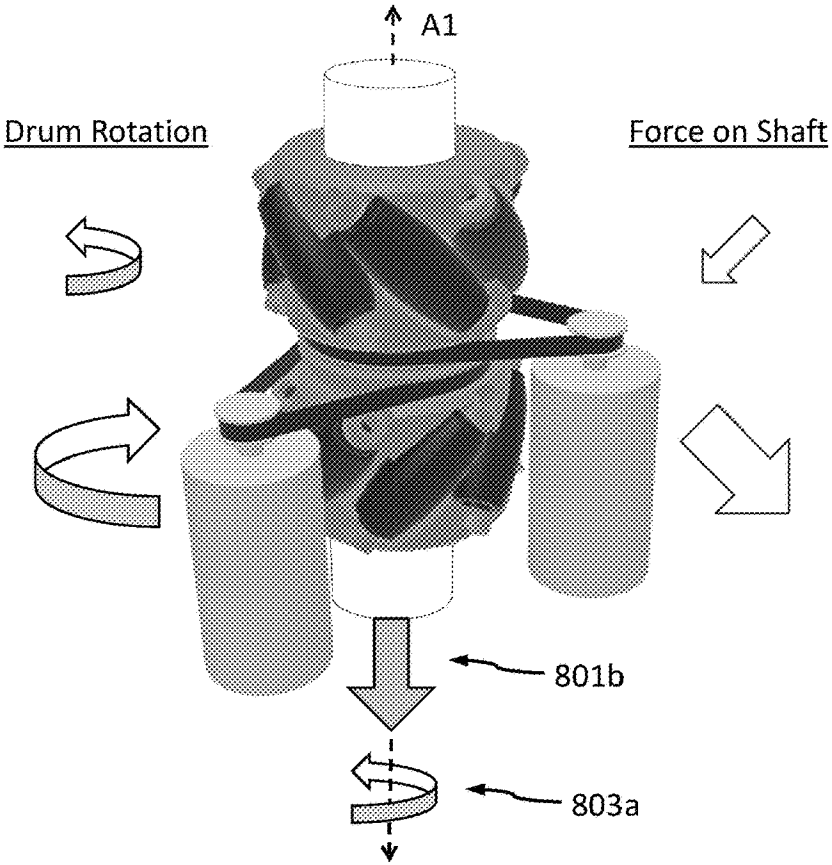

FIG. 8C depicts an example adjustment in which the shaft 102 is caused to simultaneously translate downward (as indicated by arrow 801*b*) and rotate counterclockwise (as indicated by arrow 803*a*) due to the relatively faster clockwise rotation of the lower drum 133*b*, which results in a net counterclockwise circumferential force.

Finally, FIG. 8D depicts an example adjustment in which the shaft 102 is caused to simultaneously translate downward (as indicated by arrow 801*b*) and rotate clockwise (as indicated by arrow 803*b*) due to the relatively quicker clockwise rotation of the upper drum 133*a*, which results in a net clockwise circumferential force.

Though the same various directional combinations of rotational and vertical movements of the shaft 102 are possible with both the same drum rotation directions (FIGS. 7A-D) and opposite drum rotation directions (as in FIGS. 8A-D), the relative speed of the various directional movements may differ for given differential rotational speeds. For example, if vertical movement is desired to be adjusted more rapidly than rotation of the shaft 102, the example adjustment depicted in FIGS. 8A-D may be effected. In FIG. 8A, for example, the shaft 102 is caused to simultaneously rotate counterclockwise and translate vertically as in FIG. 7A. However, because upper drum 133*a* rotates clockwise and lower drum 133*b* rotates counterclockwise, the vertical component forces are additive in the upward direction while the opposed circumferential component forces are partially offset. In this manner, for the same rotation speeds and differential drum speeds applied to the configurations of FIGS. 7A and 8A, the adjustment in FIG. 7A may provide relatively quicker counterclockwise shaft rotation (indicated by the size of arrow 701*a* relative to arrow 803*a*), while the adjustment in FIG. 8A may affect a quicker upward translation (indicated by the size of arrow 801*a* relative to arrow 703*a*). Likewise, for the same rotation speeds and differential drum speeds applied to FIGS. 7B and 8B, FIG. 7B may provide relatively quicker clockwise shaft rotation (indicated by the size of arrow 701*b* relative to arrow 803*b*) and FIG. 8B affects a quicker upward translation (indicated by the size of arrow 801*a* relative to arrow 703*a*). Comparing FIGS. 7C and 8C, FIG. 7C may provide relatively quicker counterclockwise shaft rotation (indicated by the size of arrow 701*a* relative to arrow 803*a*), while FIG. 8C affects a quicker downward translation (indicated by the size of arrow 801*b* relative to arrow 703*b*) for the same rotation speeds and differential drum speeds. Finally, with reference to FIGS. 7D and 8D, FIG. 7D may provide relatively quicker clockwise shaft rotation (indicated by the size of arrow 701*b* relative to arrow 803*b*), while FIG. 8D affects a quicker downward translation (indicated by the size of arrow 801*b* relative to arrow 703*b*) for the same rotation speeds and differential drum speeds.

Example System Architecture

FIG. 9 shows a block diagram of an example trolling motor system 900 capable for use with several embodiments of the present invention. As shown, the trolling motor system 900 may include a number of different modules or components, each of which may comprise any device or means embodied in either hardware, software, or a combination of hardware and software configured to perform one or more corresponding functions. For example, the trolling motor system 900 may include a main housing 911, a trolling motor housing 951, a position adjustment assembly housing 931, and a controller 940.

The trolling motor system 900 may also include one or more communications modules configured to communicate with one another in any of a number of different manners including, for example, via a network. In this regard, the communication interface (e.g., 960) may include any of a number of different communication backbones or frameworks including, for example, Ethernet, the NMEA 2000 framework, GPS, cellular, WiFi, Bluetooth, or other suitable networks. The network may also support other data sources, including GPS, autopilot, engine data, compass, radar, etc. Numerous other peripheral, remote devices such as one or more wired or wireless multi-function displays may be connected to the trolling motor system 900.

As shown, the main housing 911 may include a processor 936, a sonar signal processor 961, a memory 962, a communication interface 960, a display 963, a user interface 964, and one or more sensors (e.g., location sensor 965, a position sensor 966*a*, etc.). The processor 936 and/or a sonar signal processor 961 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 936 as described herein.

In this regard, the processor 936 may be configured to analyze electrical signals communicated thereto to perform various functions described herein, such as determine and adjust drive signals for the steering assembly or providing display data to the display 963 (or other remote display). In some example embodiments, the processor 936 or sonar signal processor 961 may be configured to receive sonar data indicative of the size, location, shape, etc. of objects detected by the system 900 (such as from sonar transducer assembly 967 associated with the trolling motor housing 951). For example, the processor 936 may be configured to receive sonar return data and process the sonar return data to generate sonar image data for display to a user. In some embodiments, the processor 936 may be further configured to implement signal processing or enhancement features to improve the display characteristics or data or images, collect or process additional data, such as time, temperature, GPS information, waypoint designations, or others, or may filter extraneous data to better analyze the collected data. The processor 936 may further implement notices and alarms, such as those determined or adjusted by a user, to reflect depth, presence of fish, proximity of other watercraft, etc.

The memory 962 may be configured to store instructions, computer program code, marine data, such as position adjustment data, sonar data, chart data, location/position data, and other data in a non-transitory computer readable medium for use, such as by the processor 936.

The communication interface 960 may be configured to enable connection to external systems (e.g., an external network 968). In this manner, the processor 936 may retrieve stored data from a remote, external server via the external network 968 in addition to or as an alternative to the onboard memory 962.

In various aspects, one or more position sensors may be contained within one or more of the main housing 911, the trolling motor housing 951, the position adjustment assembly housing 931, or remotely. As shown in FIG. 9, for example, a position sensor 966*a* may be in the main housing 911 and/or a position sensor 966*b* may be disposed in the trolling motor housing 951. In some embodiments, the position sensor(s) 966*a,b* may be configured to determine a direction of which the trolling motor housing is facing and/or a vertical position of the trolling motor housing. In some embodiments, the position sensor(s) 966*a,b* may be operably coupled to the shaft or trolling motor housing 951, such that the position sensor(s) 966 measures the rotational change in position of the trolling motor housing 951 as the trolling motor 952 is turned. The position sensor(s) 966*a,b* may be a magnetic sensor, a light sensor, mechanical sensor, an orientation sensor, or the like.

The location sensor 965 may be configured to determine the current navigational position and/or location of the main housing 911. For example, the location sensor 965 may comprise a GPS, bottom contour, inertial navigation system, such as micro electro-mechanical sensor (MEMS), a ring laser gyroscope, or the like, or other location detection system.

The display 963 may be configured to display images and may include or otherwise be in communication with a user interface 964 configured to receive input from a user. The display 963 may be, for example, a conventional LCD (liquid crystal display), an LED display, or the like. In some example embodiments, additional displays may also be included, such as a touch screen display, mobile device, or any other suitable display known in the art upon which images may be displayed. In any of the embodiments, the display 963 may be configured to display an indication of the current direction of the trolling motor housing 951 relative to the watercraft. Additionally, the display may be configured to display other relevant trolling motor information including, but not limited to, speed data, motor data battery data, current operating mode, auto pilot, operation mode, or the like.

The user interface 964 may include, for example, a keyboard, keypad, function keys, mouse, scrolling device, input/output ports, touch screen, or any other mechanism by which a user may interface with the system.

As shown in FIG. 9, the main housing 911 may also include one or more motor drivers 969 (e.g., circuitry operating under the control of processor 936) for applying a drive signal to each of the motors 934*a,b* within the position adjustment assembly housing 931. The one or more motor drivers 969 may comprise any known or hereafter developed circuitry modified in accordance with the present teachings that is effective to apply drive signals to the motors 934*a,b* so as to control the motors' direction of rotation, speed of rotation, duration of operation, etc. to effectuate the desired rotational and/or vertical adjustments to the trolling motor housing 951 as otherwise discussed herein.

The trolling motor housing 951 may include a trolling motor 952, a sonar transducer assembly 967, and/or one or more other sensors (e.g., a motor sensor, position sensor 966*b*, water temperature sensor, water current sensor, etc.), which may each be controlled through the processor 936 (such as otherwise detailed herein).

The controller 940 may include a foot pedal assembly, such as foot pedal assembly 140 (FIG. 2) or a handheld controller, such as handheld controller 145 (FIG. 2). The controller 940 may be in communication with the processor 936 via wired or wireless communication. The controller 940 may provide steering commands to the processor 936. The processor 936 may, in turn, cause the steering assembly to steer the trolling motor housing 951 and/or operate the trolling motor 952 based on the steering commands. The controller may include a user interface 964', a display 963', and/or a communication interface 960' (such as for wired or wireless communication). In some embodiments, the controller 940 may be embodied as or within a remote computing device, such as a marine electronic device used in conjunction with the associated watercraft, a user's mobile computing device, or other remote computing device.

The display 963' may be configured to display images and may include or otherwise be in communication with a user interface 964' configured to receive input from a user. The display 963' may be, for example, a conventional LCD (liquid crystal display), an LED display, or the like. In some example embodiments, additional displays may also be included, such as a touch screen display, mobile device, or any other suitable display known in the art upon which images may be displayed. In some embodiments, the display 963' may be configured to display an indication of the current direction of the trolling motor housing 951 relative to the watercraft. Additionally, the display may be configured to display other relevant trolling motor information including, but not limited to, speed data, motor data battery data, current operating mode, auto pilot, operation mode, or the like.

The user interface 964' may include, for example, a keyboard, keypad, function keys, mouse, scrolling device, input/output ports, touch screen, foot pedal, or any other mechanism by which a user may interface with the system.

In an example embodiment, the position adjustment assembly housing 931, similar to position adjustment assembly housing 131 (FIG. 2) may include two motors 934*a,b*, each of which is coupled to a drum 933*a,b* via a respective belt drive 935*a,b*, gear drive, or the like to rotate and/or translate the trolling motor housing 951 to be positioned in a desired rotational and/or vertical position in response to position adjustment control signals provided by the processor 936 as otherwise discussed herein. Though the processor 936 and motor driver 969 are depicted in FIG. 9 is shown as being contained within the main housing 911, it will be appreciated in light of the present teachings that the processor 936 and motor driver 969 involved with the position adjustment in accordance with the present teachings can instead, for example, be disposed together or separately within the position adjustment assembly housing 931 or be otherwise located.

Example Flowchart(s) and Operations

Embodiments of the present invention provide various methods for operating a position adjustment assembly for adjusting the rotational and/or vertical position of a trolling motor. Various examples of the operations performed in accordance with embodiments of the present invention will now be provided with reference to FIG. 10.

FIG. 10 illustrates a flowchart according to an example method 1000 for operating a position adjustment assembly for adjusting the rotational and/or vertical position of a marine device such as a trolling motor coupled to a shaft. The operations illustrated in and described with respect to FIG. 10 may, for example, be performed by, with the assistance of, and/or under the control of one or more of the processor 936, sonar signal processor 961, memory 962, communication interface 960, user interfaces 964, location sensor 965, display 963, position sensor(s) 966, and controller 940 (FIG. 9).

The method 1000 for operating the position adjustment assembly depicted in FIG. 10 may include receiving one or more position adjustment commands from the wired or wireless controller at operation 1002 and determining a motor driver setting based on the position adjustment command at operation 1004, wherein the motor driver setting comprises a direction of rotation of each of the rotatable drums and a target speed of rotation to effectuate the rotational and/or vertical adjustment indicated by the position adjustment command. The method 1000 can further include applying a drive signal (e.g., simultaneously or near simultaneously) to each of the motors in operation 1006 such that each motor causes the drum associated therewith to rotate in a commanded circumferential direction and/or at a desired speed.

FIG. 10 illustrates a flowchart of a system, method, and computer program product according to an example embodiment. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 962 and executed by, for example, the processor 936 (FIG. 9). As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A trolling motor assembly configured for attachment to a watercraft, the trolling motor assembly comprising:

a shaft extending along a central axis from a first end to a second end;

a trolling motor at least partially contained within a trolling motor housing, wherein the trolling motor housing is attached to the second end of the shaft, wherein, when the trolling motor assembly is attached to the watercraft and the trolling motor housing is submerged in a body of water, the trolling motor, when operating, is configured to propel the watercraft to travel along the body of water;

a trolling motor adjustment assembly configured to adjust at least one of a rotational position or a vertical position of the trolling motor, the trolling motor adjustment assembly comprising:

a plurality of rotatable drums surrounding the shaft, wherein each drum comprises a plurality of rollers disposed about an outer surface of the shaft and configured to be in contact therewith; and a trolling motor adjustment assembly control system, comprising:

a processor;

a memory including program code configured to, when executed, cause the processor to:

receive a position adjustment command;

apply a first drive signal to cause a first drum of the plurality of rotatable drums to rotate about the shaft in one of a first or second circumferential direction in response to the position adjustment command; and apply a second drive signal to cause a second drum of the plurality of rotatable drums to rotate about the shaft in one of a first or second circumferential direction in response to the position adjustment command;

wherein the first and second drive signals are configured to cause the trolling motor assembly to at least one of rotate about the central axis of the shaft or to translate along the central axis of the shaft.

2. The trolling motor assembly of claim 1, further comprising a first motor associated with the first drum and a second motor associated with the second drum, wherein the first drive signal is configured to control the operation of the first motor and the second drive signal is configured to control the operation of the second motor.

3. The trolling motor assembly of claim 2, wherein the first motor is operatively coupled to the first drum via a first drive belt and the second motor is operatively coupled to the second drum via a second drive belt.

4. The trolling motor assembly of claim 1, further comprising a housing configured to contain the plurality of rotatable drums, the housing comprising at least one through-hole through which the shaft extends, wherein the at least one through-hole is configured to form a seal with the outer surface of the shaft.

5. The trolling motor assembly of claim 1, wherein each of the plurality of rollers comprises a resilient material configured to be compressed against the outer surface of the shaft.

6. The trolling motor assembly of claim 5, wherein the resilient material comprises rubber.

7. The trolling motor assembly of claim 1, wherein each of the plurality of rollers extend along a respective longitudinal axis, wherein each of the respective longitudinal axes of the plurality of rollers is angled obliquely relative to the first and second circumferential directions of rotation and the central axis of the shaft.

8. The trolling motor assembly of claim 7, wherein the respective longitudinal axes of the plurality of rollers are offset by about 45 degrees relative to the central axis.

9. The trolling motor assembly of claim 1, wherein the first and second drive signals are configured to cause the trolling motor assembly to translate along the central axis of the shaft in an instance in which the circumferential directions of rotation of the first and second drums are opposite.

10. The trolling motor assembly of claim 9, wherein:

(i) when the first drive signal is configured to cause the first drum to rotate about the central axis of the shaft in the first circumferential direction and the second drive signal is configured to cause the second drum to rotate about the central axis of the shaft in the second circumferential direction, the trolling motor assembly translates in a first axial direction; and (ii) when the first drive signal is configured to cause the first drum to rotate about the central axis of the shaft in the second circumferential direction and the second drive signal is configured to cause the second drum to rotate about the central axis of the shaft in the first circumferential direction, the trolling motor assembly translates in a second axial direction opposite to the first axial direction.

11. The trolling motor assembly of claim 9, wherein a difference in speed between the circumferential rotations of the first and second drums is further configured to cause the trolling motor assembly to rotate about the central axis of the shaft while the trolling motor assembly translates along the central axis of the shaft.

12. The trolling motor assembly of claim 1, wherein the first and second drive signals are configured to cause the trolling motor assembly to rotate about the central axis of the shaft in an instance in which the circumferential directions of rotation of the first and second drums are the same.

13. The trolling motor assembly of claim 12, wherein:

(i) when the first drive signal is configured to cause the first drum to rotate about the central axis of the shaft in the first circumferential direction and the second drive signal is configured to cause the second drum to rotate about the central axis of the shaft in the first circumferential direction, the trolling motor assembly rotates about the central axis in a first direction; and (ii) when the first drive signal is configured to cause the first drum to rotate about the central axis of the shaft in the second circumferential direction and the second drive signal is configured to cause the second drum to rotate about the central axis of the shaft in the second circumferential direction, the trolling motor assembly rotates about the central axis in a second direction opposite to the first direction.

14. The trolling motor assembly of claim 12, wherein a difference in speed between the circumferential rotations of the first and second drums is further configured to cause the trolling motor assembly to translate along the central axis of the shaft.

15. A method comprising:

receiving a position adjustment command for a marine device assembly, wherein the marine device assembly is configured for attachment to a watercraft, wherein the marine device assembly comprises:

a shaft extending along a central axis from a first end to a second end;

a marine device at least partially contained within a marine device housing, wherein the marine device housing is attached to the second end of the shaft;

a marine device adjustment assembly comprising:

a plurality of rotatable drums surrounding the shaft, wherein each drum comprises a plurality of rollers disposed about an outer surface of the shaft and configured to be in contact therewith; and applying a first drive signal to cause a first drum of the plurality of rotatable drums to rotate about the shaft in one of a first or second circumferential direction in response to the position adjustment command; and applying a second drive signal to cause a second drum of the plurality of rotatable drums to rotate about the shaft in one of a first or second circumferential direction in response to the position adjustment command, wherein the first and second drive signals are configured to cause the marine device assembly to at least one of rotate about the central axis of the shaft or to translate along the central axis of the shaft.

16. The method of claim 15, wherein the first and second drive signals are applied to respective first and second drums simultaneously.

17. The method of claim 15, wherein the first and second drive signals applied to respective first and second drums are configured to cause the trolling motor assembly to rotate about the central axis of the shaft without translating along the central axis of the shaft.

18. The method of claim 15, wherein the first and second drive signals applied to respective first and second drums are configured to cause the trolling motor assembly to translate along the central axis of the shaft without rotating about the central axis of the shaft.

19. The method of claim 15, wherein the marine device assembly includes at least one sonar transducer.

20. The method of claim 15, wherein the marine device assembly includes a trolling motor.

21. A marine device assembly configured for attachment to a watercraft, the marine device assembly comprising:

a marine device adjustment assembly configured to adjust at least one of a rotational position or a vertical position of a trolling motor or sonar transducer attached to a shaft extending along a central axis, the marine device adjustment assembly comprising:

a plurality of rotatable drums surrounding the shaft, wherein each drum comprises a plurality of rollers disposed about an outer surface of the shaft and configured to be in contact therewith; and a marine device adjustment assembly control system, comprising:

a processor;

a memory including program code configured to, when executed, cause the processor to:

receive a position adjustment command;

apply a first drive signal to cause a first drum of the plurality of rotatable drums to rotate about the shaft in one of a first or second circumferential direction in response to the position adjustment command; and apply a second drive signal to cause a second drum of the plurality of rotatable drums to rotate about the shaft in one of a first or second circumferential direction in response to the position adjustment command;

wherein the first and second drive signals are configured to cause the trolling motor or sonar transducer to at least one of rotate about the central axis of the shaft or to translate along the central axis of the shaft.

* * * * *